US009967941B2

(12) United States Patent
Zhai et al.

(10) Patent No.: US 9,967,941 B2
(45) Date of Patent: May 8, 2018

(54) SYSTEMS AND METHODS FOR TEMPERATURE CONTROL IN LIGHT-EMITTING-DIODE LIGHTING SYSTEMS

(71) Applicant: ON-BRIGHT ELECTRONICS (SHANGHAI) CO., LTD., Shanghai (CN)

(72) Inventors: Xiangkun Zhai, Shanghai (CN); Liqiang Zhu, Shanghai (CN); Qiang Luo, Shanghai (CN)

(73) Assignee: ON-BRIGHT ELECTRONICS (SHANGHAI) CO., LTD., Shanghai (CN)

( * ) Notice: Subject to any disclaimer, the term of this patent is extended or adjusted under 35 U.S.C. 154(b) by 81 days.

(21) Appl. No.: 14/743,238

(22) Filed: Jun. 18, 2015

(65) Prior Publication Data

US 2016/0338165 A1 Nov. 17, 2016

(30) Foreign Application Priority Data

May 13, 2015 (CN) ..... 2015 1 0240930

(51) Int. Cl.
*H05B 33/08* (2006.01)

(52) U.S. Cl.
CPC ..... *H05B 33/0854* (2013.01)

(58) Field of Classification Search
None
See application file for complete search history.

(56) References Cited

U.S. PATENT DOCUMENTS 5,974,064 A * 10/1999 Uchida ..... H01S 5/068 372/31
6,567,922 B1 * 5/2003 Feng ..... H02M 1/32 323/205

(Continued)

FOREIGN PATENT DOCUMENTS

CN 201995175 9/2011
CN 103167665 6/2013

(Continued)

OTHER PUBLICATIONS

Taiwan Patent Office, Office Action dated Apr. 28, 2016, in Application No. 104118016.

*Primary Examiner* — Crystal L Hammond
(74) *Attorney, Agent, or Firm* — Faegre Baker Daniels LLP

(57) ABSTRACT

Systems and methods are provided for regulating one or more currents. An example system controller includes: a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes. The modulation-and-driver component is further configured to, in response to the detected temperature increasing from a first temperature threshold but remaining smaller than a second temperature threshold, generate the drive signal to keep the drive current at a first current magnitude, the second temperature threshold being higher than the first temperature threshold.

36 Claims, 18 Drawing Sheets

(56) References Cited

U.S. PATENT DOCUMENTS

| | | | | |
|---|---|---|---|---|
| 7,115,888 | B2 * | 10/2006 | Hachiya | H05B 33/0815 250/552 |
| 7,262,559 | B2 * | 8/2007 | Tripathi | H05B 33/0815 315/291 |
| 7,635,957 | B2 * | 12/2009 | Tripathi | H05B 33/0815 315/224 |
| 7,723,922 | B2 * | 5/2010 | Lee | G09G 3/3406 315/210 |
| 7,940,015 | B2 * | 5/2011 | Chitta | H05B 41/2856 315/118 |
| 8,456,096 | B2 * | 6/2013 | Kwok | H02M 1/32 315/219 |
| 8,946,995 | B2 * | 2/2015 | Pflaum | H05B 37/0227 315/120 |
| 8,975,951 | B2 * | 3/2015 | Inoue | G06F 1/206 327/350 |
| 9,270,179 | B2 * | 2/2016 | Chang | H02M 3/1584 |
| 2008/0129265 | A1 * | 6/2008 | Rosenthal | H02M 3/156 323/283 |
| 2010/0171435 | A1 | 7/2010 | Chitta et al. | |
| 2011/0193542 | A1 | 8/2011 | Kwok et al. | |
| 2013/0038218 | A1 * | 2/2013 | Xu | G05B 15/02 315/151 |

FOREIGN PATENT DOCUMENTS

| | | |
|---|---|---|
| CN | 103281835 | 9/2013 |
| CN | 104219835 | 12/2014 |
| EP | 2309825 A1 | 4/2011 |
| TW | 200826019 | 6/2008 |
| TW | 200839692 | 10/2008 |
| TW | I462638 | 11/2014 |

* cited by examiner

SYSTEMS AND METHODS FOR TEMPERATURE CONTROL IN LIGHT-EMITTING-DIODE LIGHTING SYSTEMS

1. CROSS-REFERENCES TO RELATED APPLICATIONS

This application claims priority to Chinese Patent Application No. 201510240930.9, filed May 13, 2015, incorporated by reference herein for all purposes.

2. BACKGROUND OF THE INVENTION

Certain embodiments of the present invention are directed to integrated circuits. More particularly, some embodiments of the invention provide a system and method for thermal control. Merely by way of example, some embodiments of the invention have been applied to light emitting diodes (LEDs). But it would be recognized that the invention has a much broader range of applicability.

In systems including light emitting diodes (LEDs), heat dissipation of control chips and/or the systems usually becomes a concern with the increase of forward conducting currents of LEDs and the decrease of the packaging size of the control chips. To prevent a control chip and/or LEDs from being overheated, the control chip often detects the change of the system temperature. If the system temperature increases to a certain level, the control chip usually enters an over-temperature-protection mode and eventually shuts down the system. A temperature control mechanism can be implemented to reduce drive currents of LEDs if the system temperature reaches a threshold so as to prevent the system temperature from continuing to rise.

Power of an LED lighting system (e.g., an LED lamp) is usually determined by as follows:

$$P_d=V_f*I_f \tag{1}$$

where $P_d$ represents the power of the LED lamp, $V_f$ represents the voltage of the LED lamp, and $I_f$ represents the loss current of the LED lamp.

Heat generated by the LED lamp often needs to be dissipated (e.g., through a thermal resistance related to the package of the LED system) so as to keep the LED lamp safe. An ambient temperature (e.g., the temperature outside the LED lamp) may rise with the heat dissipation of the LED lamp, and in turn reduce the heating dissipation of the LED lamp. The LED control system (e.g., a control chip) is inside of the LED lamp, which also includes one or more LEDs. The ambient temperature is related to the power and the heat dissipation of the LED lamp. A difference between a junction temperature of the LED control system and the ambient temperature can be determined as follows:

$$T_j-T_a=P_d*\theta_{ja} \tag{2}$$

where $T_j$ represents a junction temperature of the LED control system, $T_a$ represents the ambient temperature, and $\theta_{ja}$ represents the thermal resistance related to the package of the LED control system. According to Equation (2), the junction temperature can be sensed to regulate the power delivered to the LED lamp so as to control the temperature inside of the LED lamp for over-heat protection and for prevention of thermal runaway of the LED lamp.

According to the Equations (1) and (2), the temperature of the LED control system can be detected, and the currents of the LEDs can be adjusted to achieve feedback control of the temperature of the LED control system. For example, if a temperature of a control chip increases to a certain level, the control chip adjusts a drive current associated with one or more LEDs to prevent the temperature of the control chip and/or the ambient temperature from continuing to increase.

FIG. 1 is a simplified conventional diagram showing a relationship of a drive current associated with one or more LEDs and a temperature of an LED control system for temperature control. As shown in FIG. 1, the drive current associated with the one or more LEDs keeps at a magnitude (e.g., $I_{LED_NOM}$) if the temperature of the LED control system is smaller than a temperature threshold (e.g., $T_{BK}$). If the temperature of the LED control system exceeds the temperature threshold (e.g., $T_{BK}$), the LED control system decreases the drive current to reduce the temperature of the LED control system. For example, the magnitude of the drive current changes at a negative slope with the temperature of the LED control system. As an example, if the temperature of the LED control system increases to a higher magnitude $T_0$, the LED control system reduces the drive current to a current magnitude $L_{LED_0}$. If the temperature of the LED control system increases to another magnitude $T_{END0}$, the LED control system reduces the drive current to a low magnitude (e.g., 0).

The temperature control mechanism as shown in FIG. 1 has some disadvantages, such as flickering of the LEDs under certain circumstances. Hence it is highly desirable to improve the techniques of temperature control in LED systems.

3. BRIEF SUMMARY OF THE INVENTION

Certain embodiments of the present invention are directed to integrated circuits. More particularly, some embodiments of the invention provide a system and method for thermal control. Merely by way of example, some embodiments of the invention have been applied to light emitting diodes (LEDs). But it would be recognized that the invention has a much broader range of applicability.

According to one embodiment, a system controller for regulating one or more currents includes: a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes. The modulation-and-driver component is further configured to: in response to the detected temperature increasing from a first temperature threshold but remaining smaller than a second temperature threshold, generate the drive signal to keep the drive current at a first current magnitude, the second temperature threshold being higher than the first temperature threshold; in response to the detected temperature increasing to become equal to or larger than the second temperature threshold, change the drive signal to reduce the drive current from the first current magnitude to a second current magnitude, the second current magnitude being smaller than the first current magnitude; in response to the detected temperature decreasing from the second temperature threshold but remaining larger than the first temperature threshold, generate the drive signal to keep the drive current at the second current magnitude; and in response to the detected temperature decreasing to become equal to or smaller than the first temperature threshold, change the drive signal to increase the drive current from the second current magnitude to the first current magnitude.

According to another embodiment, a system controller for regulating one or more currents includes: a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes. The modulation-and-driver component is further configured to: in response to the detected temperature increasing to become larger than a first temperature threshold but remaining smaller than a second temperature threshold, change the drive signal to reduce the drive current approximately according to an exponential function of the detected temperature, the first temperature threshold being smaller than the second temperature threshold.

According to yet another embodiment, a method for regulating one or more currents includes: detecting a temperature; generating a thermal detection signal based at least in part on the detected temperature; receiving the thermal detection signal; and generating a drive signal based at least in part on the thermal detection signal to close or open a switch to affect a drive current associated with one or more light emitting diodes. The generating the drive signal based at least in part on the thermal detection signal to close or open the switch to affect the drive current associated with the one or more light emitting diodes includes: in response to the detected temperature increasing from a first temperature threshold but remaining smaller than a second temperature threshold, generating the drive signal to keep the drive current at a first current magnitude, the second temperature threshold being higher than the first temperature threshold; in response to the detected temperature increasing to become equal to or larger than the second temperature threshold, changing the drive signal to reduce the drive current from the first current magnitude to a second current magnitude, the second current magnitude being smaller than the first current magnitude; in response to the detected temperature decreasing from the second temperature threshold but remaining larger than the first temperature threshold, generating the drive signal to keep the drive current at the second current magnitude; and in response to the detected temperature decreasing to become equal to or smaller than the first temperature threshold, changing the drive signal to increase the drive current from the second current magnitude to the first current magnitude.

According to yet another embodiment, a method for regulating one or more currents includes: detecting a temperature; generating a thermal detection signal based at least in part on the detected temperature; receiving the thermal detection signal; and generating a drive signal based at least in part on the thermal detection signal to close or open a switch to affect a drive current associated with one or more light emitting diodes. The generating the drive signal based at least in part on the thermal detection signal to close or open the switch to affect the drive current associated with the one or more light emitting diodes includes: in response to the detected temperature increasing to become larger than a first temperature threshold but remaining smaller than a second temperature threshold, changing the drive signal to reduce the drive current approximately according to an exponential function of the detected temperature, the first temperature threshold being smaller than the second temperature threshold.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

Certain embodiments of the present invention are directed to integrated circuits. More particularly, some embodiments of the invention provide a system and method for thermal control. Merely by way of example, some embodiments of the invention have been applied to light emitting diodes (LEDs). But it would be recognized that the invention has a much broader range of applicability.

Figure 1:
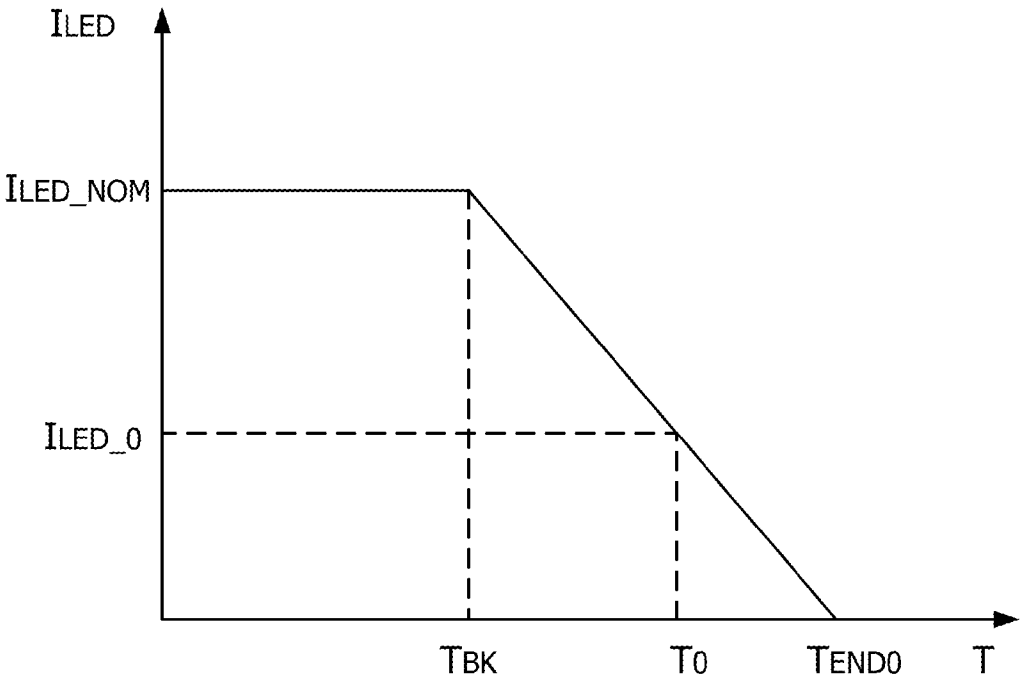
Figure 1 Prior Art
FIG. 1 is a simplified conventional diagram showing a relationship of a drive current associated with one or more LEDs and a temperature of an LED control system for temperature control.

The temperature control mechanism as shown in FIG. 1 often reduces the LED drive current quickly to zero if the system temperature (e.g., a junction temperature of the LED control system) reaches a high magnitude (e.g., $T_{END}$), which may cause flickering of the LEDs. However, different applications of LED lighting systems often have different requirements for LED brightness (e.g., corresponding to different LED drive currents). For example, under some circumstances, the brightness of the LEDs often needs to be kept above a particular level.

Figure 2:
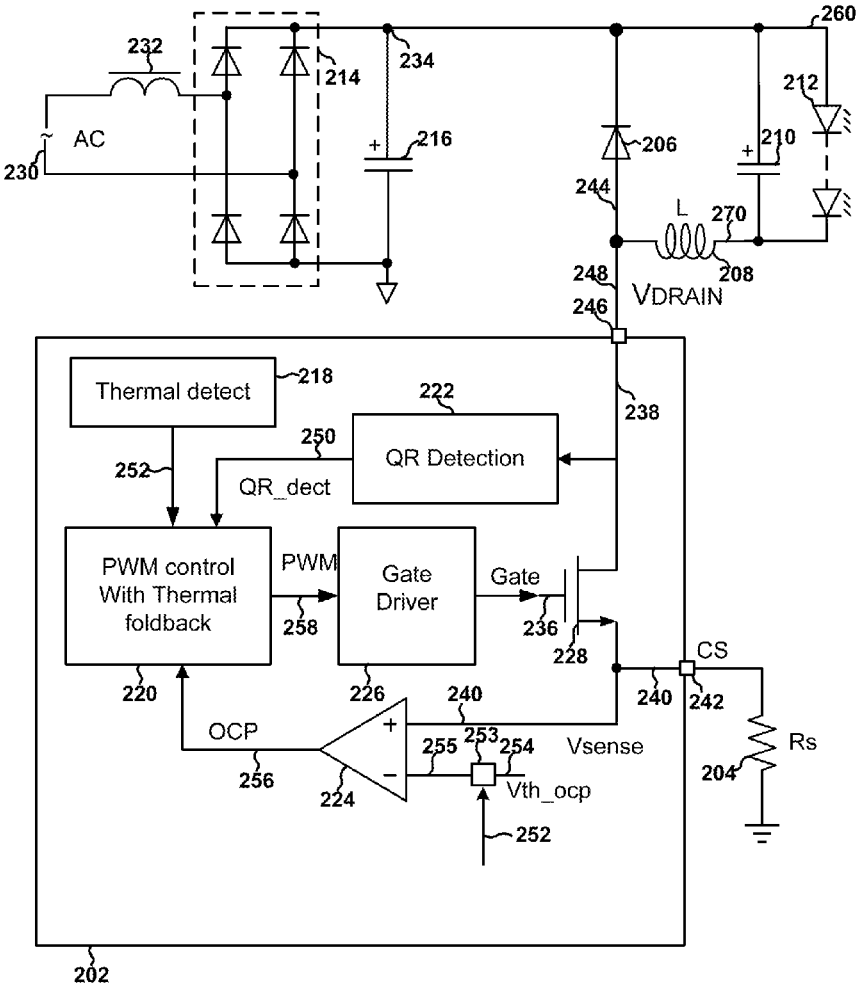
FIG. 2 is a simplified diagram showing a system including one or more LEDs for temperature control according to an embodiment of the present invention.

FIG. 2 is a simplified diagram showing a system including one or more LEDs for temperature control according to an embodiment of the present invention. This diagram is merely an example, which should not unduly limit the scope of the claims. One of ordinary skill in the art would recognize many variations, alternatives, and modifications.

The LED lighting system 200 (e.g., an LED lamp) includes a system controller 202, a resistor 204, a diode 206, an inductor 208, capacitors 210 and 216, a rectifying bridge 214, an inductive component 232 (e.g., a transformer), and one or more LEDs 212. The system controller 202 includes a thermal detector 218, a modulation component 220, an operation-mode detection component 222, a comparator 224, a driving component 226, a signal processing component 253, and a switch 228. For example, the switch 228 includes a metal-oxide-semiconductor field effect transistor (MOSFET). In another example, the switch 228 includes a bipolar junction transistor. In yet another example, the switch 228 includes an insulated-gate bipolar transistor. As shown in FIG. 2, the system 200 implements a BUCK topology, according to some embodiments.

According to one embodiment, an alternate-current input signal 230 is applied for driving the one or more LEDs 212. For example, the inductive component 232, the rectifying bridge 214 and the capacitor 216 operate to generate an input signal 234. As an example, if the switch 228 is closed (e.g., being turned on) in response to a drive signal 236, i.e., during an on-time period (e.g., $T_{on}$), a current 238 flows through the inductor 208, the switch 228 and the resistor 204. In another example, the inductor 208 stores energy. In yet another example, a voltage signal 240 (e.g., $V_{sense}$) is generated by the resistor 204. In yet another example, the voltage signal 240 is proportional in magnitude to the product of the current 238 and the resistance of the resistor 204. In yet another example, the voltage signal 240 is detected at a terminal 242 (e.g., CS).

If the switch 228 is open (e.g., being turned off) in response to the drive signal 236, an off-time period (e.g., $T_{off}$) begins, and a demagnetization process of the inductor 208 starts according to some embodiments. For example, a current 244 flows from the inductor 208 through the diode 206 to the one or more LEDs 212. In another example, an output current 260 flows through the one or more LEDs 212. In yet another example, a voltage signal 248 (e.g., $V_{DRAIN}$) associated with the inductor 208 is detected at a terminal 246 (e.g., DRAIN) by the system controller 202.

According to another embodiment, the operation-mode detection component 222 detects the voltage signal 248 and generates an operation-mode detection signal 250. As an example, if the operation-mode detection component 222 detects a valley (e.g., a low magnitude) in the voltage signal 248, a pulse is generated in the operation-mode detection signal 250 corresponding to the detected valley. For example, the thermal detector 218 includes a P-N junction for detecting the temperature of the system controller 202. As an example, the thermal detector 218 generates a thermal detection signal 252 based at least in part on the temperature of the system controller 202, and the signal processing component 253 combines a threshold signal 254 (e.g., $V_{th_ocp}$) and the thermal detection signal 252 to generate a signal 255. In another example, the comparator 224 receives the voltage signal 240 and the signal 255 and generates a protection signal 256 (e.g., OCP). In yet another example, the modulation component 220 receives the operation-mode detection signal 250 and the protection signal 256 and outputs a modulation signal 258 to the driving component 226 that generates the drive signal 236.

According to certain embodiments, a drive current $I_{LED}$ (e.g., an average of the output current 260) is determined as follows:

$$I_{LED} = 0.5 * I_{PK} * \frac{T_{on} + T_{DEM}}{T_{on} + T_{off}} \tag{3}$$

where $I_{LED}$ represents the drive current, $I_{PK}$ represents a peak current that flows through the one or more LEDs 212, $T_{on}$ represents the on-time period during which the switch 228 is being turned on, $T_{DEM}$ represents a demagnetization period associated with a demagnetization process of the system 200, and $T_{off}$ represents the off-time period during which the switch 228 is being turned off. For example, the drive current $I_{LED}$ (e.g., an average of the output current 260) is further determined as follows:

$$I_{LED} = 0.5 * I_{PK} * \frac{T_{on} + T_{DEM}}{T_{on} + T_{off}} = 0.5 * \frac{V_{th_ocp}}{R_s} \tag{4}$$

where $V_{th_ocp}$ represents the threshold signal 254, and $R_s$ represents the resistance of the resistor 204. As an example, if the system 200 operates in a quasi-resonance (QR) mode, the demagnetization period $T_{DEM}$ is equal in duration to the off-time period $T_{off}$. Equation (4) applies to a certain system temperature range, according to some embodiments.

According to some embodiments, the system controller 202 implements a temperature control mechanism in which the system controller 202 adjusts the signal 255 based at least in part on the detected system temperature (e.g., a junction temperature of the system controller 202) to change the drive current (e.g., an average of the output current 260 that flows through the one or more LEDs 212) with the temperature. For example, the drive current changes with the temperature at a negative slope in a certain temperature range. According to certain embodiments, the system controller 202 implements another temperature control mechanism in which the system controller 202 adjusts the duration of the off-time period based at least in part on the detected system temperature to change the drive current (e.g., an average of the output current 260 that flows through the one or more LEDs 212) with the temperature. For example, the drive current changes with the temperature non-linearly in a particular temperature range. As an example, the drive current changes approximately according to an exponential function of the temperature.

As discussed above and further emphasized here, FIG. 2 is merely an example, which should not unduly limit the scope of the claims. One of ordinary skill in the art would recognize many variations, alternatives, and modifications. In one embodiment, the system controller 202 is implemented in a BUCK-BOOST power conversion architecture to realize temperature control. In another embodiment, the system controller 202 is implemented for a fly-back power conversion architecture to realize temperature control.

Figure 3:
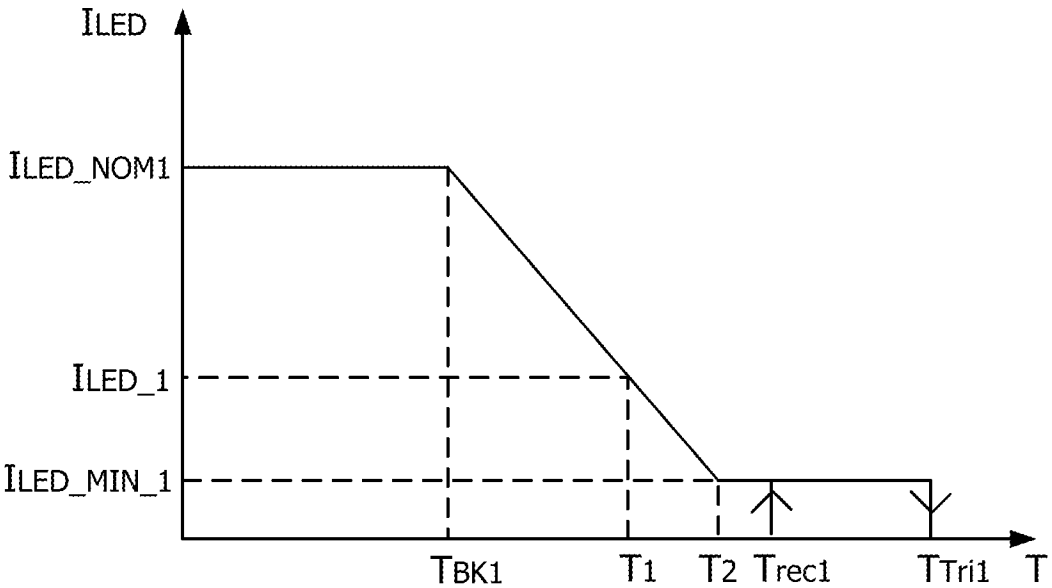
FIG. 3 is a simplified diagram showing a relationship of a drive current associated with one or more LEDs and the temperature of a system controller for temperature control according to an embodiment of the present invention.

FIG. 3 is a simplified diagram showing a relationship of a drive current associated with the one or more LEDs 212 and the temperature of the system controller 202 for temperature control according to an embodiment of the present invention. This diagram is merely an example, which should not unduly limit the scope of the claims. One of ordinary skill in the art would recognize many variations, alternatives, and modifications.

As shown in FIG. 3, the system controller 202 changes the drive current (e.g., an average of the output current 260 that flows through the one or more LEDs 212) with the temperature, according to some embodiments. For example, the drive current (e.g., $I_{LED}$) keeps at a magnitude (e.g., $I_{LED_NOM1}$) if the temperature of the system controller 202 is smaller than a temperature threshold (e.g., $T_{BK1}$). In another example, if the temperature of the system controller 202 exceeds the temperature threshold (e.g., $T_{BK1}$), the system controller 202 decreases the drive current (e.g., $I_{LED}$) in order to reduce the temperature of the system controller 202. As an example, the drive current changes in magnitude at a negative slope with the temperature of the system controller 202 in a range between the temperature threshold $T_{BK1}$ and a temperature magnitude $T_2$. In another example, if the temperature of the system controller 202 increases to a temperature magnitude $T_1$ (e.g., smaller than the temperature magnitude $T_2$), the system controller 202 changes the drive current to a current magnitude $L_{LED_1}$. In yet another example, if the temperature of the system controller 202 reaches the magnitude $T_2$, the drive current decreases to a lower current limit (e.g., $I_{LED_min1}$). In yet another example, the system controller 202 keeps the drive current (e.g., $I_{LED}$) approximately equal in magnitude to the lower current limit (e.g., $I_{LED_min1}$) in a range between the temperature magnitude $T_2$ and another temperature threshold $T_{Tri1}$. In yet another example, if the temperature of the system controller 202 increases to become equal to or larger than the temperature threshold $T_{Tri1}$, the system controller 202 decreases the drive current to a low magnitude (e.g., 0). In yet another example, the system controller 202 stops operation.

According to one embodiment, if the temperature of the system controller 202 decreases to become equal to or smaller than another temperature threshold $L_{rec1}$, the system controller 202 begins operation again. For example, the system controller 202 keeps the drive current at the lower current limit (e.g., $I_{LED_min1}$) in a range between the temperature threshold $T_{rec1}$ and the temperature magnitude $T_2$. In another example, the drive current changes in magnitude at a negative slope with the temperature of the system controller 202 in a range between the temperature threshold $T_{BK1}$ and the temperature magnitude $T_2$. In yet another example, if the temperature of the system controller 202 decreases to below the temperature threshold $T_{BK1}$, the system controller 202 keeps the drive current at the current threshold $I_{LED_NOM1}$. In yet another example, the temperature threshold $L_{rec1}$ is equal to the temperature magnitude $T_2$.

Figure 4A:
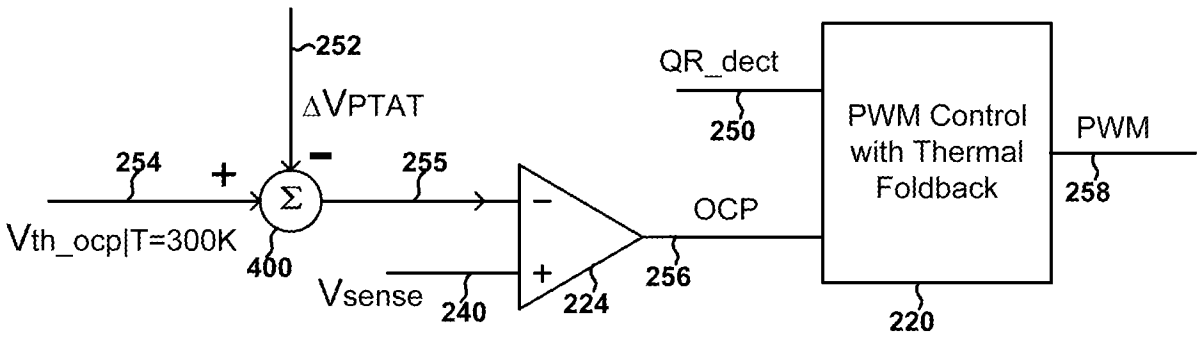
FIG. 4(A) is a simplified diagram showing certain components of the system controller as part of the system as shown in FIG. 2 according to one embodiment of the present invention.

FIG. 4(A) is a simplified diagram showing certain components of the system controller 202 as part of the system 200 according to one embodiment of the present invention. This diagram is merely an example, which should not unduly limit the scope of the claims. One of ordinary skill in the art would recognize many variations, alternatives, and modifications.

As shown in FIG. 4(A), a summation component 400 combines the threshold voltage 254 (e.g., being a predetermined threshold voltage associated with a temperature of 300 K) and the thermal detection signal 252 (e.g., changing with the detected system temperature) and generates the signal 255, according to certain embodiments. For example, within a certain temperature range, the system controller 202 adjusts the signal 255 by changing the thermal detection signal 252 with the detected system temperature. As an example, the summation component 400 is included in the signal processing component 253.

Figure 4B:
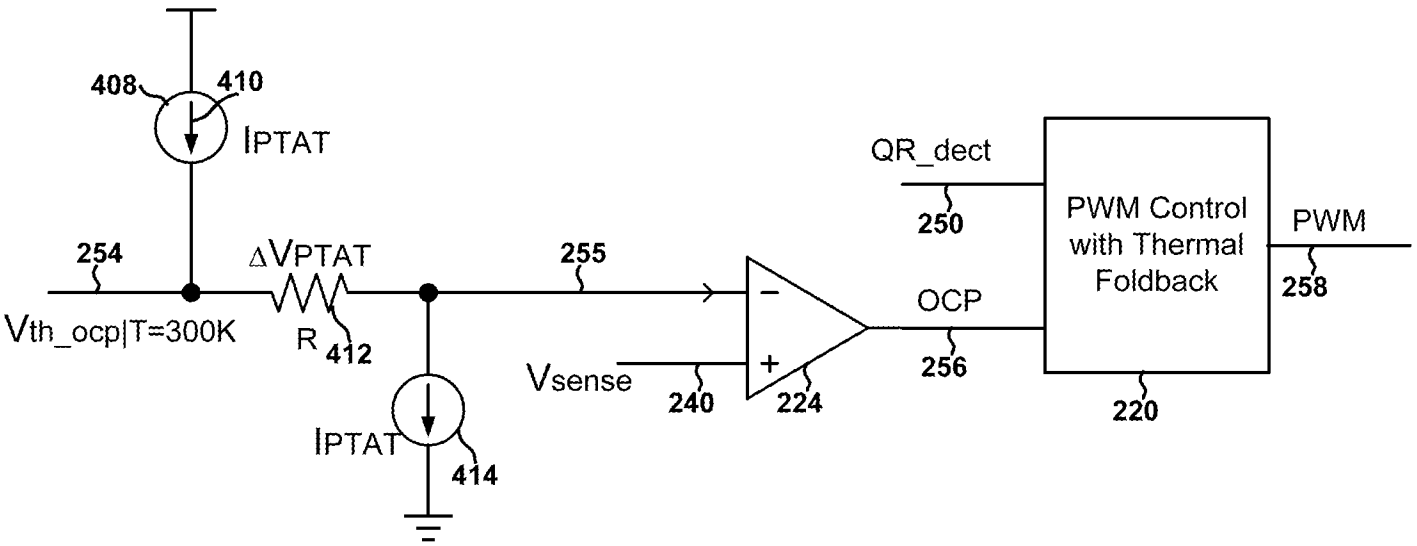
FIG. 4(B) is a simplified diagram showing certain components of the system controller as part of the system as shown in FIG. 2 according to another embodiment of the present invention.

FIG. 4(B) is a simplified diagram showing certain components of the system controller 202 as part of the system 200 according to another embodiment of the present invention. This diagram is merely an example, which should not unduly limit the scope of the claims. One of ordinary skill in the art would recognize many variations, alternatives, and modifications. As shown in FIG. 4(B), the system controller 202 further includes a resistor 412 and two current source components 408 and 414. For example, the current source component 408 is included in the thermal detector 218. In another example, the resistor 412 and the current source component 414 is included in the signal processing component 253.

According to one embodiment, an adjustment current 410 is generated by the current source component 408 for temperature control. For example, the adjustment current 410 is determined as follows:

$$I_{PTAT}=K*T \tag{5}$$

where $I_{PTAT}$ represents the adjustment current 410, T represents the temperature of the system controller 202, and K represents a coefficient. If the temperature of the system controller 202 exceeds a threshold (e.g., $T_{BK1}$ as shown in FIG. 3), a voltage drop $\Delta V_{PTAT}$ (e.g., the thermal detection signal 252 as shown in FIG. 4(A)) is generated by the resistor 412, according to some embodiments. For example, the voltage drop $\Delta V_{PTAT}$ is determined as follows:

$$\Delta V_{PTAT}=I_{PTAT}*R \tag{6}$$

where $\Delta V_{PTAT}$ represents the voltage drop (e.g., the thermal detection signal 252), and R represents the resistance of the resistor 412 through which the adjustment current 410 flows.

According to one embodiment, the signal 255 is equal in magnitude to a difference between the threshold signal 254 and the voltage drop $\Delta V_{PTAT}$ (e.g., the thermal detection signal 252). As an example, the signal 255 is determined as follows:

$$V_{th_ocp}(T)=V_{th_ocp}(300K)-I_{PTAT}*R=V_{th_ocp}(300K)-K*T*R \quad (7)$$

where $V_{th_ocp}(T)$ represents the signal 255 and $V_{th_ocp}(300K)$ represents the threshold signal 254. According to some embodiments, a drive current (e.g., the average of the output current 260) is determined as follows based on Equation (4) and Equation (7):

$$I_{LED}=0.5*\frac{V_{th_ocp}(300\ K)-K*T*R}{R_s} \quad (8)$$

According to Equation (8), the system controller 202 changes the drive current linearly (e.g., with a negative slope) with the detected system temperature, according to certain embodiments.

Figure 5:
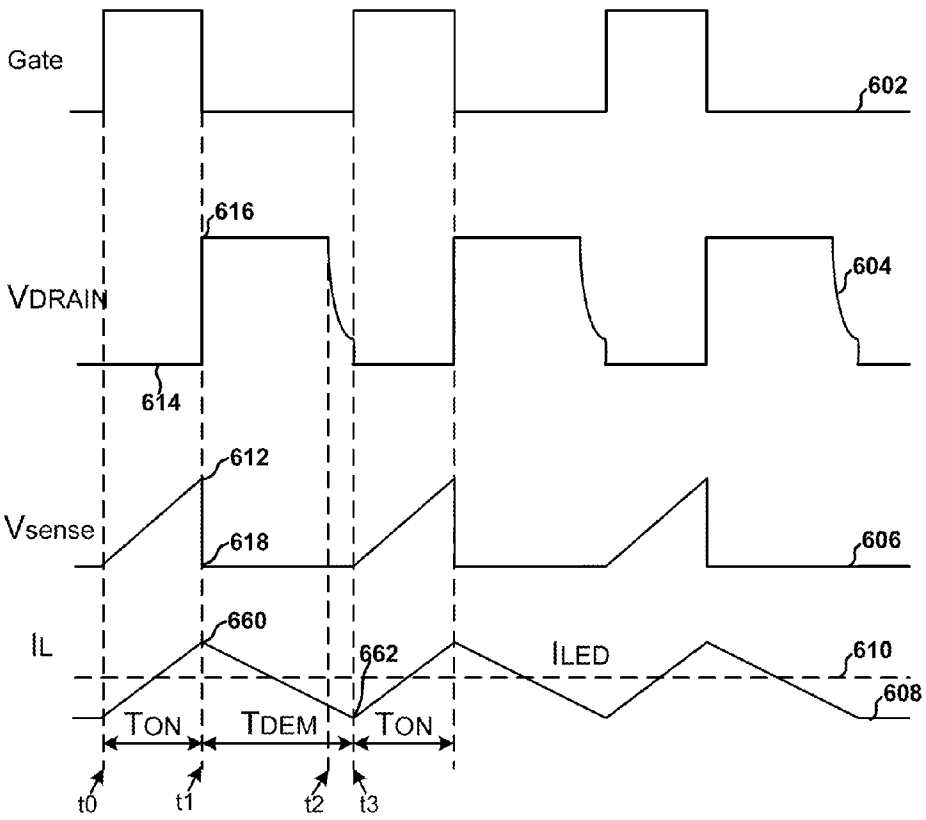
FIG. 5 is a simplified timing diagram if the temperature of a system controller is below a threshold for the system as shown in FIG. 2 according to one embodiment of the present invention.

FIG. 5 is a simplified timing diagram if the temperature of the system controller 202 is below a threshold for the system 200 according to one embodiment of the present invention. This diagram is merely an example, which should not unduly limit the scope of the claims. One of ordinary skill in the art would recognize many variations, alternatives, and modifications. As shown in FIG. 5, the waveform 602 represents the drive signal 236 as a function of time, the waveform 604 represents the voltage signal 248 (e.g., $V_{DRAIN}$) as a function of time, the waveform 606 represents the voltage signal 240 (e.g., $V_{sense}$) as a function of time, and the waveform 608 represents a current 270 that flows through the inductor 208 as a function of time.

According to one embodiment, when the system temperature is below the threshold (e.g., $T_{BK1}$ as shown in FIG. 3), the system 200 operates in a normal QR mode in which the temperature control mechanism is not activated. For example, a drive current (e.g., the average of the output current 260 that flows through the one or more LEDs 212) is kept at a magnitude 610 (e.g., $I_{LED_NOM1}$ as shown in FIG. 3). As an example, when the drive signal 236 is at a logic high level during an on-time period (e.g., between $t_0$ and $t_1$ as shown by the waveform 602), the switch 228 is closed (e.g., being turned on), and the voltage signal 240 (e.g., $V_{sense}$) increases in magnitude (e.g., to a magnitude 612 at $t_1$) as shown by the waveform 606. In another example, the current 270 increases in magnitude (e.g., from below the magnitude 610 to a magnitude 660 that is larger than the magnitude 610) as shown by the waveform 608. In yet another example, the voltage signal 248 (e.g., $V_{DRAIN}$) keeps at a low magnitude 614 (e.g., as shown by the waveform 604). As an example, the magnitude 612 corresponds to the signal 255.

According to another embodiment, when the drive signal 236 changes from the logic high level to a logic low level (e.g., at $t_1$) as shown by the waveform 602, the switch 228 is opened (e.g., being turned off). For example, the voltage signal 240 (e.g., $V_{sense}$) decreases rapidly to a low magnitude 618 (e.g., 0) as shown by the waveform 606. In another example, the current 270 that flows through the inductor 208 begins to decrease in magnitude (e.g., as shown by the waveform 608). In yet another example, the voltage signal 248 (e.g., $V_{DRAIN}$) increases rapidly in magnitude (e.g., from the low magnitude 614 to a magnitude 616) as shown by the waveform 604.

According to yet another embodiment, during a demagnetization period (e.g., $T_{DEM}$) associated with a demagnetization process of the inductor 208 (e.g., between $t_1$ and $t_3$), the drive signal 236 is kept at the logic low level (e.g., as shown by the waveform 602), and the switch 228 is kept open (e.g., being off). For example, the voltage signal 240 (e.g., $V_{sense}$) keeps at the low magnitude 618 (e.g., 0) as shown by the waveform 606. In another example, the current 270 that flows through the inductor 208 decreases in magnitude (e.g., from the magnitude 660 to a magnitude 662 that is smaller than the magnitude 610) as shown by the waveform 608. In yet another example, the voltage signal 248 (e.g., $V_{DRAIN}$) keeps at the magnitude 616 between $t_1$ and $t_2$ and then decreases in magnitude between $t_2$ and $t_3$. In yet another example, the demagnetization period (e.g., $T_{DEM}$) is equal in duration to an off-time period.

According to yet another embodiment, at the beginning of a next on-time period (e.g., $t_3$), the drive signal 236 changes from the logic low level to the logic high level (e.g., as shown by the waveform 602), and the switch 228 is closed (e.g., being turned on). For example, the voltage signal 240 (e.g., $V_{sense}$) increases in magnitude (e.g., as shown by the waveform 606). In another example, the current 270 begins to increase in magnitude (e.g., as shown by the waveform 608). In yet another example, the voltage signal 248 (e.g., $V_{DRAIN}$) decreases rapidly in magnitude (e.g., to the magnitude 614) as shown by the waveform 604.

Figure 6:
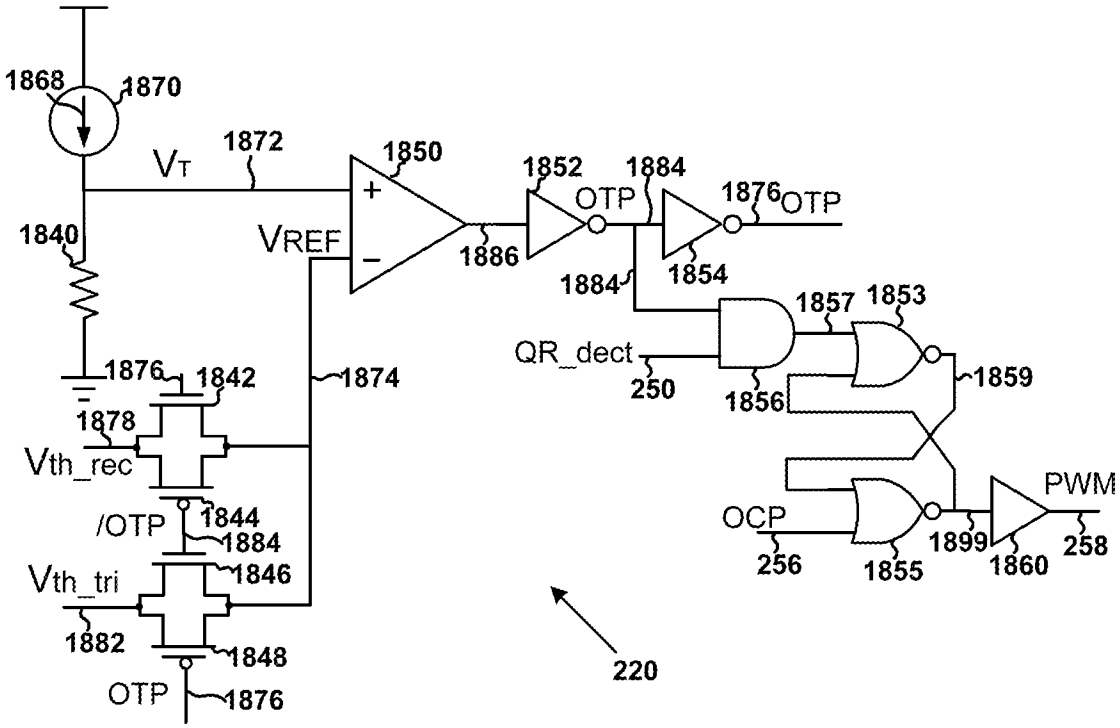
FIG. 6 is a simplified diagram showing certain components of a modulation component as part of the system as shown in FIG. 2 according to one embodiment of the present invention.

FIG. 6 is a simplified diagram showing certain components of the modulation component 220 as part of the system 200 according to one embodiment of the present invention. This diagram is merely an example, which should not unduly limit the scope of the claims. One of ordinary skill in the art would recognize many variations, alternatives, and modifications. As shown in FIG. 6, the modulation component 220 includes N-channel transistors 1842 and 1846, P-channel transistors 1844 and 1848, a resistor 1840, a comparator 1850, NOT gates 1852 and 1854, an AND gate 1856, a buffer 1860, NOR gates 1853 and 1855, and a current source component 1868.

According to one embodiment, the current source component 1868 generates a current 1870 (e.g., $I_{PTAT}$), and the resistor 1840 provides a voltage signal 1872 (e.g., $V_T$). As an example, the current 1870 is proportional in magnitude to a temperature of the system controller 202. As another example, the comparator 1850 receives the voltage signal 1872 and a reference signal 1874 and generates a comparison signal 1886 to the NOT gate 1852 which outputs a signal 1884 (e.g., /OTP) to the NOT gate 1854. In another example, the NOT gate 1854 outputs a signal 1876 (e.g., OTP) in response to the signal 1884. In yet another example, the AND gate 1856 receives the signal 1884 and the operation-mode detection signal 250 (QR_dect) and outputs a signal 1857 to the NOR gate 1853. In yet another example, the NOR gate 1853 and the NOR gate 1855 are cross-connected. For example, the output terminal of the NOR gate 1853 is connected to an input terminal of the NOR gate 1855, and the output terminal of the NOR gate 1855 is connected to an input terminal of the NOR gate 1853. As an example, the NOR gate 1855 receives the protection signal 256 (e.g., OCP) and outputs a signal 1899 to the buffer 1860 which outputs the modulation signal 258 (e.g., PWM).

According to another embodiment, the transistors 1842 and 1848 receive the signal 1876 (e.g., OTP) at their gate terminals, and the transistors 1844 and 1846 receive the signal 1884 (e.g., /OTP) at their gate terminals. For example, a threshold voltage 1878 (e.g., $V_{th_rec}$) is provided to the transistors 1842 and 1844 at their source/drain terminals, and another threshold voltage 1882 (e.g., $V_{th_tri}$) is provided to the transistors 1846 and 1848 at their source/drain terminals. In another example, the transistors 1842, 1844, 1846 and 1848 are configured to provide the reference signal 1874 to the comparator 1850.

In one embodiment, if the signal 1876 (e.g., OTP) is set to a logic low level (e.g., "0") and the signal 1884 (e.g., /OTP) is set to a logic high level (e.g., "1"), the transistors 1842 and 1844 are opened (e.g., being turned off), and the transistors 1846 and 1848 are closed (e.g., being turned on). As an example, the reference signal 1874 (e.g., $V_{REF}$) is approximately equal in magnitude to the threshold voltage 1882 (e.g., $V_{th_tri}$). As another example, if the temperature of the system controller 202 is smaller than the temperature threshold $T_{Tri1}$, the signal 1872 (e.g., $V_T$) is smaller in magnitude than the reference signal 1874 (e.g., $V_{REF}$), and the comparator 1850 outputs the comparison signal 1886 at the logic low level (e.g., "0"). As yet another example, the signal 1884 (e.g., /OTP) changes to the logic high level (e.g., "1") and the signal 1876 (e.g., OTP) changes to the logic low level (e.g., "0").

In another embodiment, in response to the signal 1884 (e.g., /OTP) being at the logic high level (e.g., "1"), the AND gate 1856 outputs the signal 1857 according to the signal 250 (e.g., QR_dect). For example, if the signal 250 (e.g., QR_dect) is at the logic high level, the signal 1857 is at the logic high level and the NOR gate 1853 outputs a signal 1859 at the logic low level. As an example, if the protection signal 256 (e.g., OCP) is at the logic low level which indicates that the over-current protection mechanism is not to be activated, the NOR gate 1855 outputs the signal 1899 at the logic high level and the buffer 1860 outputs the modulation signal 258 (e.g., PWM) at the logic high level. In another example, if the signal 250 (e.g., QR_dect) is at the logic low level, the signal 1857 is at the logic low level and the signal 1899 remains at the logic high level (e.g., unless the protection signal 256 changes to the logic high level).

In yet another embodiment, if the temperature of the system controller 202 increases to become larger than the temperature threshold $T_{Tri1}$ (e.g., as shown in FIG. 3), the signal 1872 (e.g., $V_T$) increases to become larger in magnitude than the reference signal 1874 (e.g., $V_{REF}$) which is approximately equal in magnitude to the threshold voltage 1882 (e.g., $V_{th_tri}$), and the comparator 1850 outputs the comparison signal 1886 at the logic high level (e.g., "1"). For example, in response, the signal 1884 (e.g., /OTP) changes to the logic low level (e.g., "0") and the signal 1876 (e.g., OTP) changes to the logic high level (e.g., "1"). As an example, the AND gate 1856 outputs the signal 1857 at the logic low level (e.g., "0") regardless of the value of the signal 250 (e.g., QR_dect), and thus the signal 250 (e.g., QR_dect) is masked. As another example, the signal 1899 is determined by the protection signal 256 (e.g., OCP). As yet another example, if the protection signal 256 (e.g., OCP) changes to the logic high level (e.g., "1"), the signal 1899 changes to the logic low level (e.g., "0"), and the modulation signal 258 changes to the logic low level (e.g., "0"). As yet another example, the driving component 226 outputs the drive signal 236 at the logic low level (e.g., "0"), and in response the switch 228 is opened (e.g., being turned off). As yet another example, the switch 228 remains open for a period of time, and normal operations of the system 200 are stopped.

As the signal 1884 (e.g., /OTP) changes to the logic low level (e.g., "0") and the signal 1876 (e.g., OTP) changes to the logic high level (e.g., "1"), the transistors 1842 and 1844 are closed (e.g., being turned on), and the transistors 1846 and 1848 are opened (e.g., being turned off), according to certain embodiments. For example, the reference signal 1874 (e.g., $V_{REF}$) is approximately equal in magnitude to the threshold voltage 1878 (e.g., $V_{th_rec}$). In another example, if the temperature of the system controller 202 decreases to become smaller than the temperature threshold $T_{rec1}$ (e.g., as shown in FIG. 3), the signal 1872 (e.g., $V_T$) becomes smaller in magnitude than the reference signal 1874 (e.g., $V_{REF}$) which is approximately equal in magnitude to the threshold voltage 1878 (e.g., $V_{th_rec}$), and the comparator 1850 outputs the comparison signal 1886 at the logic low level (e.g., "0"). In response, the signal 1884 (e.g., /OTP) changes to the logic high level (e.g., "1") and the signal 1876 (e.g., OTP) changes to the logic low level (e.g., "0"). In yet another example, in response to the signal 1884 (e.g., /OTP) being at the logic high level (e.g., "1"), the AND gate 1856 outputs the signal 1857 according to the signal 250 (e.g., QR_dect) again. As an example, the driving component 226 outputs the drive signal 236 to close and open the switch 228 at a certain frequency, and the system 200 performs normal operations. In some embodiments, the NOR gates 1853 and 1855 are removed, and the AND gate 1856 outputs the signal 1899 to the buffer 1860.

Figure 7:
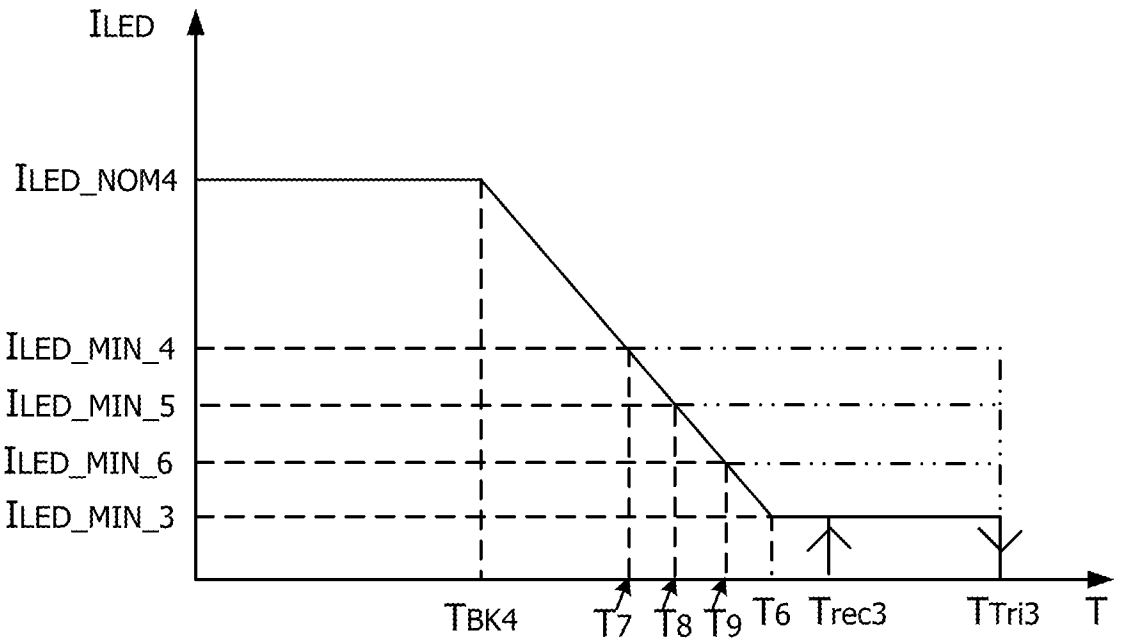
FIG. 7 is a simplified diagram showing adjustment of a lower current limit associated with one or more LEDs for temperature control according to one embodiment of the present invention.

FIG. 7 is a simplified diagram showing adjustment of a lower current limit associated with the one or more LEDs 212 for temperature control according to one embodiment of the present invention. This diagram is merely an example, which should not unduly limit the scope of the claims. One of ordinary skill in the art would recognize many variations, alternatives, and modifications.

According to some embodiments, the system controller 202 adjusts a lower over-voltage-protection threshold ($V_{th_ocp_min}$) to determine a lower current limit (e.g., according to Equation (8)), according to some embodiments. For example, according to Equation (7), the signal 255 changes with temperature. As an example, if the signal 255 becomes smaller in magnitude than the lower over-voltage-protection threshold ($V_{th_ocp_min}$), the system controller 202 changes the signal 255 to be equal in magnitude to the lower over-voltage-protection threshold ($V_{th_ocp_min}$). As another example, the lower current limit is determined (e.g., within a range) based at least in part on the adjustment of the lower over-voltage-protection threshold ($V_{th_ocp_min}$). Referring back to FIG. 3, the lower current limit (e.g., $I_{LED_min1}$) can be changed by adjusting the lower over-voltage-protection threshold, according to certain embodiments.

As shown in FIG. 7, the system controller 202 changes the drive current (e.g., an average of the output current 260 that flows through the one or more LEDs 212) with the temperature, according to some embodiments. For example, the drive current (e.g., $I_{LED}$) keeps at a magnitude (e.g., $I_{LED_NOM4}$) if the temperature of the system controller 202 is smaller than a temperature threshold (e.g., $T_{BK4}$). In another example, if the temperature of the system controller 202 exceeds the temperature threshold (e.g., $T_{BK4}$), the system controller 202 decreases the drive current (e.g., $I_{LED}$) in order to reduce the temperature of the system controller 202. As an example, the drive current changes in magnitude at a negative slope with the temperature of the system controller 202 in a range between the temperature threshold $T_{BK4}$ and a temperature magnitude $T_6$. In another example, if the temperature of the system controller 202 reaches the magnitude $T_6$, the drive current decreases to a lower current limit (e.g., $I_{LED_min3}$). In yet another example, the system controller 202 keeps the drive current (e.g., $I_{LED}$) approximately equal in magnitude to the lower current limit (e.g., $I_{LED_min3}$) in a range between the temperature magnitude $T_6$ and another temperature threshold $T_{Tri3}$. In yet another example, if the temperature of the system controller 202 increases to become equal to or larger than the temperature threshold $T_{Tri3}$, the system controller 202 decreases the drive current to a low magnitude (e.g., 0). In yet another example, the system controller 202 stops normal operations.

According to one embodiment, if the temperature of the system controller 202 decreases to become equal to or larger than another temperature threshold $T_{rec3}$, the system controller 202 begins normal operations again. For example, the system controller 202 keeps the drive current at the lower current limit (e.g., $I_{LED_min3}$) in a range between the temperature threshold $T_{rec3}$ and the temperature magnitude $T_6$. In another example, the drive current changes in magnitude at a negative slope with the temperature of the system controller 202 in a range between the temperature threshold $T_{BK4}$ and the temperature magnitude $T_6$. In yet another example, if the temperature of the system controller 202 decreases to below the temperature threshold $T_{BK4}$, the system controller 202 keeps the drive current at the current threshold $I_{LED_NOM4}$.

According to another embodiment, if the lower current limit changes from $I_{LED_min3}$ to $I_{LED_min4}$, the temperature at which the drive current changes to the corresponding lower current limit changes from $T_6$ to $T_7$. For example, if the lower current limit changes $I_{LED_min5}$, the temperature at which the drive current changes to the corresponding lower current limit changes to $T_8$. In another example, if the lower current limit changes to $I_{LED_min6}$ the temperature at which the drive current changes to the corresponding lower current limit changes to $T_9$. As an example, $T_7 \leq T_8 \leq T_9 \leq T_6$.

Figure 8:
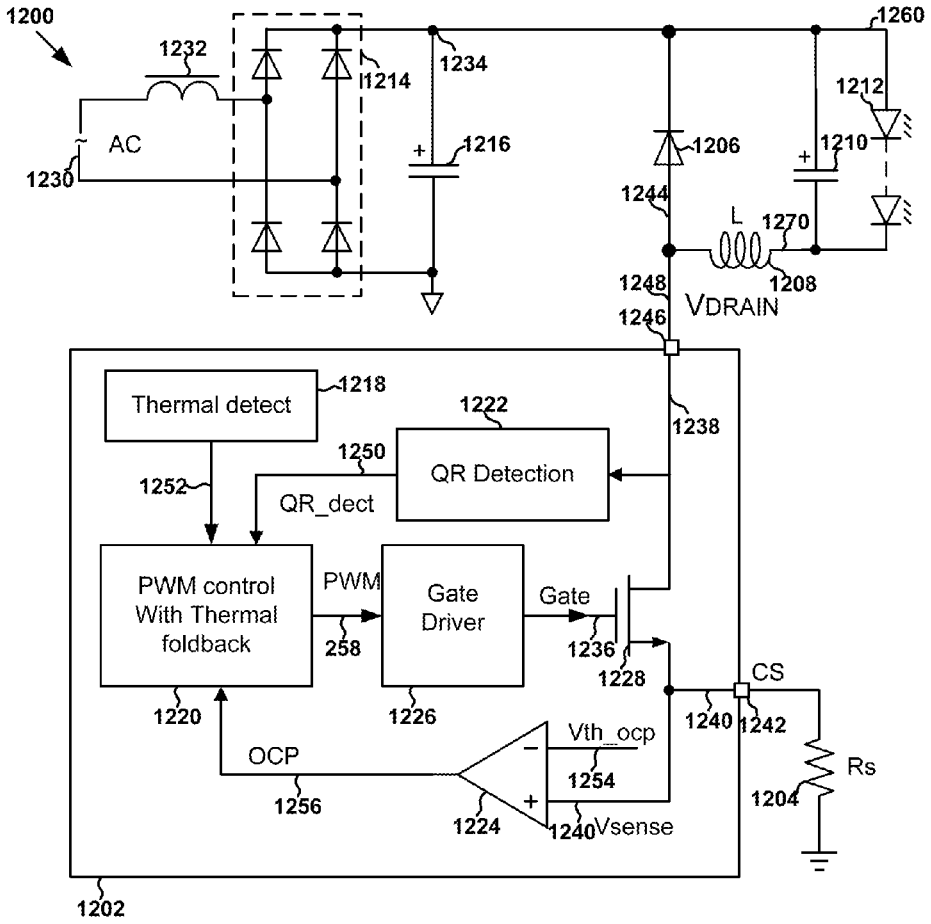
FIG. 8 is a simplified diagram showing a system including one or more LEDs for temperature control according to another embodiment of the present invention.

FIG. 8 is a simplified diagram showing a system including one or more LEDs for temperature control according to another embodiment of the present invention. This diagram is merely an example, which should not unduly limit the scope of the claims. One of ordinary skill in the art would recognize many variations, alternatives, and modifications.

The LED lighting system 1200 (e.g., an LED lamp) includes a system controller 1202, a resistor 1204, a diode 1206, an inductor 1208, capacitors 1210 and 1216, a rectifying bridge 1214, an inductive component 1232 (e.g., a transformer), and one or more LEDs 1212. The system controller 1202 includes a thermal detector 1218, a modulation component 1220, an operation-mode detection component 1222, a comparator 1224, a driving component 1226, and a switch 1228. For example, the switch 1228 includes a metal-oxide-semiconductor field effect transistor (MOSFET). In another example, the switch 1228 includes a bipolar junction transistor. In yet another example, the switch 1228 includes an insulated-gate bipolar transistor. As shown in FIG. 8, the system 1200 implements a BUCK topology, according to some embodiments.

According to one embodiment, an alternate-current input signal 1230 is applied for driving the one or more LEDs 1212. For example, the inductive component 1232, the rectifying bridge 1214 and the capacitor 1216 operate to generate an input signal 1234. As an example, if the switch 1228 is closed (e.g., being turned on) in response to a drive signal 1236, i.e., during an on-time period (e.g., $T_{on}$), a current 1238 flows through the inductor 1208, the switch 1228 and the resistor 1204. In another example, the inductor 1208 stores energy. In yet another example, a voltage signal 1240 (e.g., $V_{sense}$) is generated by the resistor 1204. In yet another example, the voltage signal 1240 is proportional in magnitude to the product of the current 1238 and the resistance of the resistor 1204. In yet another example, the voltage signal 1240 is detected at a terminal 1242 (e.g., CS).

If the switch 1228 is open (e.g., being turned off) in response to the drive signal 1236, an off-time period (e.g., $T_{off}$) begins, and a demagnetization process of the inductor 1208 starts according to some embodiments. For example, a current 1244 flows from the inductor 1208 through the diode 1206 to the one or more LEDs 1212. In another example, an output current 1260 flows through the one or more LEDs 1212. In yet another example, a voltage signal 1248 (e.g., $V_{DRAIN}$) associated with the inductor 1208 is detected at a terminal 1246 (e.g., DRAIN) by the system controller 1202.

According to another embodiment, the operation-mode detection component 1222 detects the voltage signal 1248 and generates an operation-mode detection signal 1250. As an example, if the operation-mode detection component 1222 detects a valley (e.g., a low magnitude) in the voltage signal 1248, a pulse is generated in the operation-mode detection signal 1250 corresponding to the detected valley. For example, the thermal detector 1218 includes a P-N junction for detecting the temperature of the system controller 1202. As an example, the thermal detector 1218 generates a thermal detection signal 1252 based at least in part on the temperature of the system controller 1202. In another example, the comparator 1224 receives the voltage signal 1240 and a threshold signal 1254 (e.g., $V_{th_ocp}$) and generates a protection signal 1256 (e.g., OCP). In yet another example, the modulation component 1220 receives the operation-mode detection signal 1250, the thermal detection signal 1252 and the protection signal 1256 and outputs a modulation signal 1258 to the driving component 1226 that generates the drive signal 1236.

According to certain embodiments, a drive current $I_{LED}$ (e.g., an average of the output current 1260) is determined as follows:

$$I_{LED} = 0.5 * I_{PK} * \frac{T_{on} + T_{DEM}}{T_{on} + T_{off}} \tag{9}$$

where $I_{LED}$ represents the drive current, $I_{PK}$ represents a peak current that flows through the one or more LEDs 1212, $T_{on}$ represents the on-time period during which the switch 1228 is being turned on, $T_{DEM}$ represents a demagnetization period associated with a demagnetization process of the system 1200, and $T_{off}$ represents the off-time period during which the switch 1228 is being turned off. For example, the drive current $I_{LED}$ is determined as follows:

$$I_{LED} = 0.5 * I_{PK} * \frac{T_{on} + T_{DEM}}{T_{on} + T_{off}} = 0.5 * \frac{V_{th_ocp}}{R_s} \tag{10}$$

where $V_{th_ocp}$ represents the threshold signal 1254, and $R_s$ represents the resistance of the resistor 1204. As an example, if the system 1200 operates in a quasi-resonance (QR) mode, the demagnetization period $T_{DEM}$ is equal in duration to the off-time period $T_{off}$. Equation (10) applies to a certain system temperature range, according to some embodiments.

According to some embodiments, the system controller 1202 implements a temperature control mechanism in which the system controller 1202 adjusts the threshold signal 1254 based at least in part on the detected system temperature (e.g., a junction temperature of the system controller 1202) to change the drive current (e.g., an average of the output current 1260 that flows through the one or more LEDs 1212) with the temperature. For example, the drive current changes with the temperature at a negative slope in a certain temperature range. According to certain embodiments, the system controller 1202 implements another temperature control mechanism in which the system controller 1202 adjusts the duration of the off-time period based at least in part on the detected system temperature to change the drive current (e.g., an average of the output current 1260 that flows through the one or more LEDs 1212) with the temperature. For example, the drive current changes with the temperature non-linearly in a particular temperature range. As an example, the drive current changes approximately according to an exponential function of the temperature.

As discussed above and further emphasized here, FIG. 8 is merely an example, which should not unduly limit the scope of the claims. One of ordinary skill in the art would recognize many variations, alternatives, and modifications. In one embodiment, the system controller 1202 is implemented in a BUCK-BOOST power conversion architecture to realize temperature control. In another embodiment, the system controller 1202 is implemented for a fly-back power conversion architecture to realize temperature control.

Figure 9A:
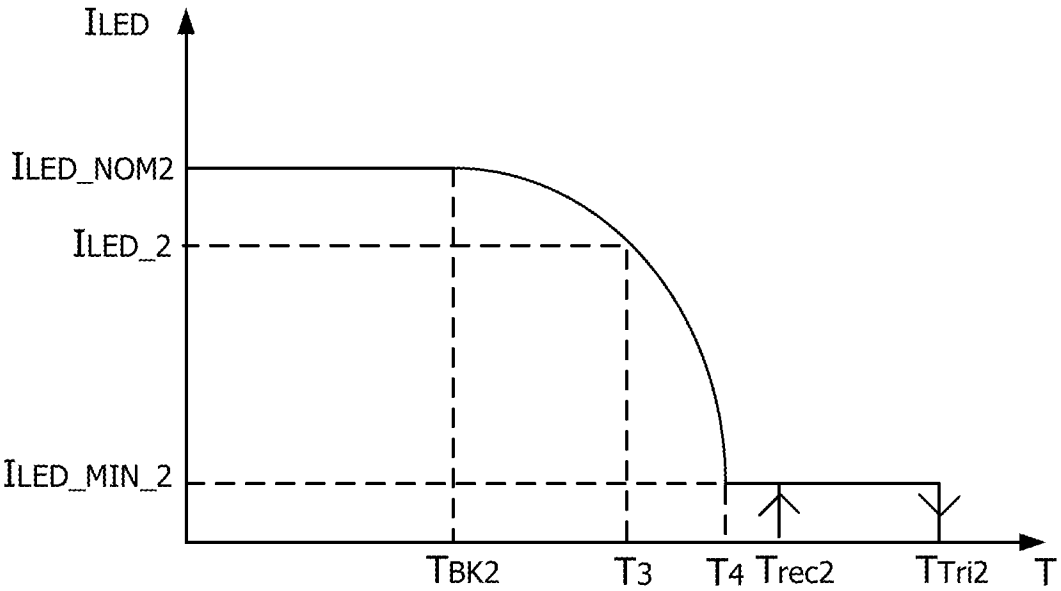
FIG. 9(A) is a simplified diagram showing a relationship of a drive current associated with the one or more LEDs and the temperature of the system controller as shown in FIG. 8 for temperature control according to one embodiment of the present invention.

FIG. 9(A) is a simplified diagram showing a relationship of a drive current associated with the one or more LEDs 1212 and the temperature of the system controller 1202 for temperature control according to one embodiment of the present invention. This diagram is merely an example, which should not unduly limit the scope of the claims. One of ordinary skill in the art would recognize many variations, alternatives, and modifications.

As shown in FIG. 9(A), the system controller 1202 changes the drive current (e.g., the average of the output current 1260 that flows through the one or more LEDs 1212) with the temperature, according to some embodiments. For example, the drive current (e.g., $I_{LED}$) keeps at a magnitude (e.g., $I_{LED_NOM2}$) if the temperature of the system controller 1202 is smaller than a temperature threshold (e.g., $T_{BK2}$). In another example, if the temperature of the system controller 1202 exceeds the temperature threshold (e.g., $T_{BK2}$), the system controller 1202 decreases the drive current in order to reduce the temperature of the system controller 1202. In some embodiments, the drive current changes in magnitude non-linearly with the temperature of the system controller 1202 in a range between the temperature threshold $T_{BK2}$ and a temperature magnitude $T_4$. As an example, the drive current changes approximately according to an exponential function of the temperature of the system controller 1202 in the range between the temperature threshold $T_{BK2}$ and the temperature magnitude $T_4$. In some embodiments, according to the exponential function, the drive current is determined, in the range between the temperature threshold $T_{BK2}$ and the temperature magnitude $T_4$, as follows:

$$I_{LED}=a-b*e^{cT} \tag{11}$$

where a, b, and c are parameters not affected by temperature. For example, a, b, and c are positive parameters not affected by temperature. In another example, the drive current is determined using an approximation technique (e.g., Taylor series) for the exponential function.

According to one embodiment, if the temperature of the system controller 1202 increases to a temperature magnitude $T_3$ (e.g., smaller than the temperature magnitude $T_4$), the system controller 1202 reduces the drive current to a current magnitude $I_{LED_2}$. For example, if the temperature of the system controller 1202 reaches the magnitude $T_4$, the drive current decreases to a lower current limit (e.g., $I_{LED_min2}$). In another example, the system controller 1202 keeps the drive current approximately equal in magnitude to the lower current limit (e.g., $I_{LED_min2}$) in a range between the temperature magnitude $T_4$ and another temperature threshold $T_{Tri2}$. In yet another example, if the temperature of the system controller 1202 increases to become equal to or larger than the temperature threshold $T_{Tri2}$, the system controller 1202 decreases the drive current to a low magnitude (e.g., 0). In yet another example, the system controller 1202 stops normal operations. In yet another example, the system controller 1202 reduces the drive current faster in the temperature range between $T_3$ and $T_4$ than in the temperature range between $T_{BK2}$ and $T_3$.

According to another embodiment, if the temperature of the system controller 1202 decreases to become equal to or smaller than temperature threshold $T_{rec2}$ the system controller 1202 begins normal operations again. For example, the system controller 1202 keeps the drive current at the lower current limit (e.g., $I_{LED_min2}$) in a range between the temperature threshold $T_{rec2}$ and the temperature magnitude $T_4$. In another example, the drive current changes in magnitude non-linearly with the temperature of the system controller 1202 in a range between the temperature threshold $T_{BK2}$ and the temperature magnitude $T_4$. In yet another example, if the temperature of the system controller 1202 decreases to below the temperature threshold $T_{BK2}$, the system controller 1202 keeps the drive current at the current threshold $I_{LED_NOM2}$.

According to certain embodiments, the system controller 1202 adjusts the duration of the off-time period based at least in part on the detected system temperature to change the drive current (e.g., non-linearly) with the temperature. For example, if the system 1200 operates in a QR mode, the off-time period is equal in duration to the demagnetization period (e.g., $T_{DEM}$). As an example, if the temperature of the system controller 1202 exceeds a threshold (e.g., $T_{BK2}$ as shown in FIG. 9(A)), an adjustment period $T_{PTAT}$ is generated based at least in part on the detected system temperature to become part of the off-time period (e.g., $T_{off}$). That is, the off-time period is determined as follows:

$$T_{off}=T_{DEM}+T_{PTAT} \tag{12}$$

According to some embodiments, the drive current (e.g., the average of the output current 1260) is determined as follows based on Equation (10) and Equation (12):

$$I_{LED}=0.5*\frac{V_{th_ocp}}{R_s}*\frac{T_{on}+T_{DEM}}{T_{on}+T_{DEM}+T_{PTAT}} \tag{13}$$

Figure 9B:
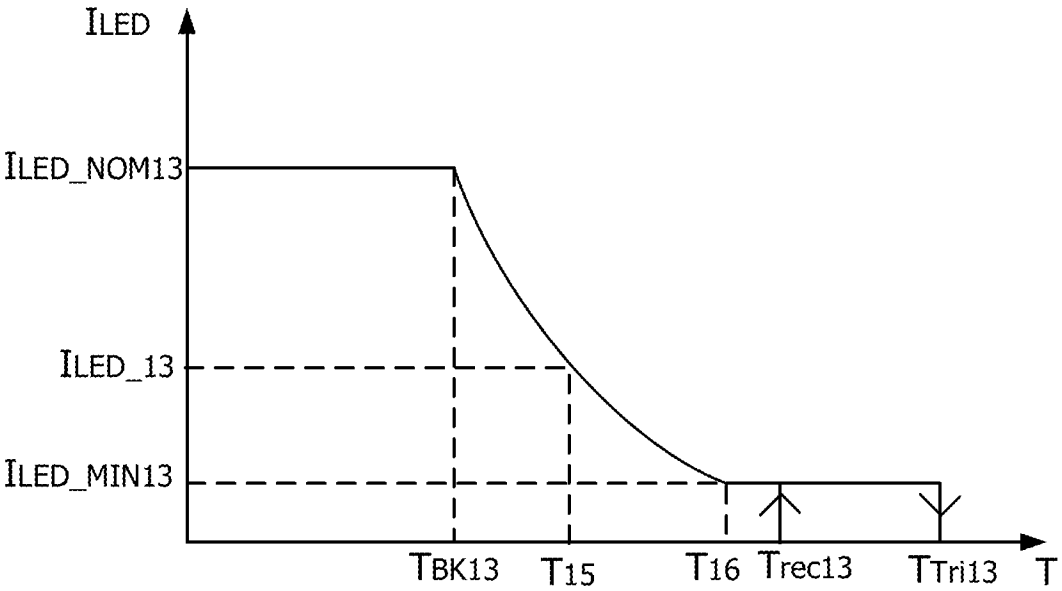
FIG. 9(B) is a simplified diagram showing a relationship of a drive current associated with the one or more LEDs and the temperature of the system controller as shown in FIG. 8 for temperature control according to another embodiment of the present invention.

FIG. 9(B) is a simplified diagram showing a relationship of a drive current associated with the one or more LEDs 1212 and the temperature of the system controller 1202 for temperature control according to another embodiment of the present invention. This diagram is merely an example, which should not unduly limit the scope of the claims. One of ordinary skill in the art would recognize many variations, alternatives, and modifications.

As shown in FIG. 9(B), the system controller 1202 changes the drive current (e.g., the average of the output current 1260 that flows through the one or more LEDs 1212) with the temperature, according to some embodiments. For example, the drive current (e.g., $I_{LED}$) keeps at a magnitude (e.g., $I_{LED_NOM13}$) if the temperature of the system controller 1202 is smaller than a temperature threshold (e.g., $T_{BK13}$). In another example, if the temperature of the system controller 1202 exceeds the temperature threshold (e.g., $T_{BK13}$), the system controller 1202 decreases the drive current in order to reduce the temperature of the system controller 1202. In some embodiments, the drive current changes in magnitude non-linearly with the temperature of the system controller 1202 in a range between the temperature threshold $T_{BK13}$ and a temperature magnitude $T_{16}$. As an example, the drive current changes approximately according to an exponential function of the temperature of the system controller 1202 in the range between the temperature threshold $T_{BK13}$ and the temperature magnitude $T_{16}$. In some embodiments, according to the exponential function, the drive current is determined, in the range between the temperature threshold $T_{BK13}$ and the temperature magnitude $T_{16}$, as follows:

$$I_{LED}=u+v*e^{-wT} \tag{14}$$

where u, v, and w are parameters not affected by temperature. For example, u, v, and w are positive parameters not affected by temperature. In another example, the drive current is determined using an approximation technique (e.g., Taylor series) for the exponential function.

According to one embodiment, if the temperature of the system controller 1202 increases to a temperature magnitude $T_{15}$ (e.g., smaller than the temperature magnitude $T_{16}$), the system controller 1202 reduces the drive current to a current magnitude $I_{LED_13}$. For example, if the temperature of the system controller 1202 reaches the magnitude $T_{16}$, the drive current decreases to a lower current limit (e.g., $I_{LED_min13}$). In another example, the system controller 1202 keeps the drive current approximately equal in magnitude to the lower current limit (e.g., $I_{LED_min13}$) in a range between the temperature magnitude $T_{16}$ and another temperature threshold $T_{Tri13}$. In yet another example, if the temperature of the system controller 1202 increases to become equal to or larger than the temperature threshold $T_{Tri13}$, the system controller 1202 decreases the drive current to a low magnitude (e.g., 0). In yet another example, the system controller 1202 stops normal operations. In yet another example, the system controller 1202 reduces the drive current slower in the temperature range between $T_{15}$ and $T_{16}$ than in the temperature range between $T_{BK13}$ and $T_{15}$.

According to another embodiment, if the temperature of the system controller 1202 decreases to become equal to or smaller than temperature threshold $T_{rec13}$, the system controller 1202 begins normal operations again. For example, the system controller 1202 keeps the drive current at the lower current limit (e.g., $I_{LED_min13}$) in a range between the temperature threshold $T_{rec13}$ and the temperature magnitude $T_{16}$. In another example, the drive current changes in magnitude non-linearly with the temperature of the system controller 1202 in a range between the temperature threshold $T_{BK13}$ and the temperature magnitude $T_{16}$. In yet another example, if the temperature of the system controller 1202 decreases to below the temperature threshold $T_{BK13}$, the system controller 1202 keeps the drive current at the current threshold $I_{LED_NOM13}$.

According to certain embodiments, the system controller 1202 adjusts the duration of the off-time period based at least in part on the detected system temperature to change the drive current (e.g., non-linearly) with the temperature. For example, if the system 1200 operates in a QR mode, the off-time period is equal in duration to the demagnetization period (e.g., $T_{DEM}$). As an example, if the temperature of the system controller 1202 exceeds a threshold (e.g., $T_{BK13}$ as shown in FIG. 9(B)), an adjustment period $T_{PTAT}$ is generated based at least in part on the detected system temperature to become part of the off-time period (e.g., $T_{off}$). That is, the off-time period is determined as follows:

$$T_{off}=T_{DEM}+T_{PTAT} \tag{15}$$

According to some embodiments, the drive current (e.g., the average of the output current 1260) is determined as follows based on Equation (10) and Equation (15):

$$I_{LED}=0.5*\frac{V_{th_ocp}}{R_s}*\frac{T_{on}+T_{DEM}}{T_{on}+T_{DEM}+T_{PTAT}} \tag{16}$$

Figure 10A:
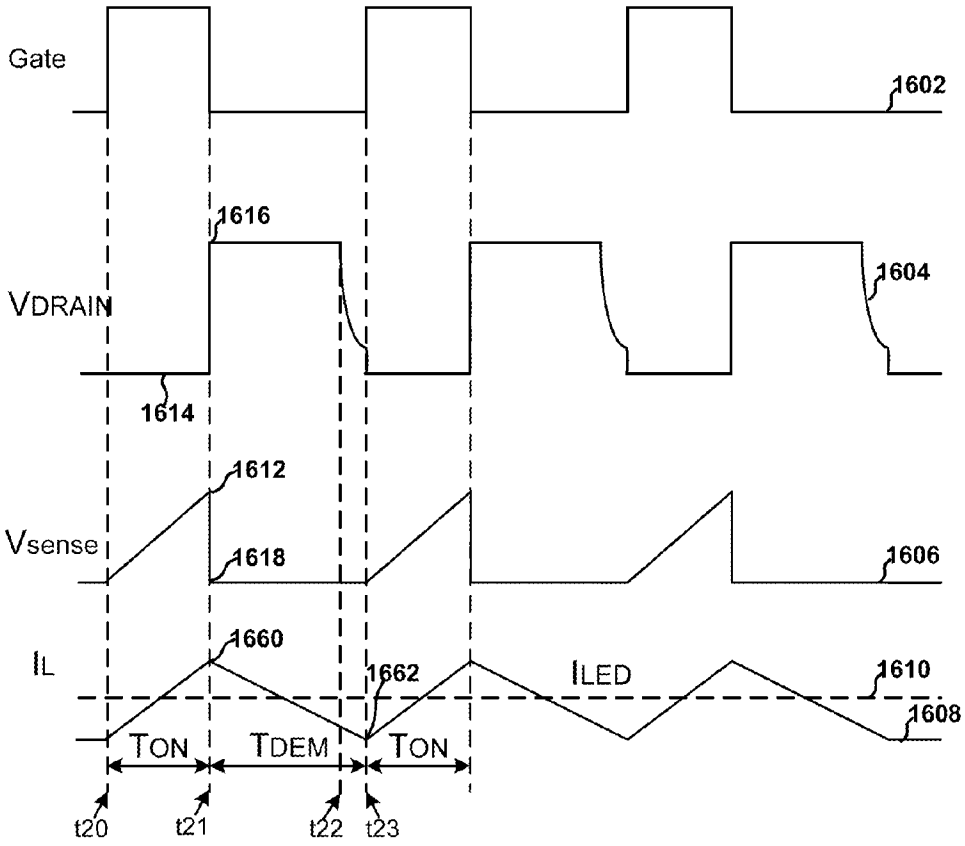
FIG. 10(A) is a simplified timing diagram if the temperature of the system controller is below a threshold for the system as shown in FIG. 8 according to one embodiment of the present invention.

FIG. 10(A) is a simplified timing diagram if the temperature of the system controller 1202 is below a threshold for the system 1200 according to one embodiment of the present invention. This diagram is merely an example, which should not unduly limit the scope of the claims. One of ordinary skill in the art would recognize many variations, alternatives, and modifications. As shown in FIG. 10(A), the waveform 1602 represents the drive signal 1236 as a function of time, the waveform 1604 represents the voltage signal 1248 (e.g., $V_{DRAIN}$) as a function of time, the waveform 1606 represents the voltage signal 1240 (e.g., $V_{sense}$) as a function of time, and the waveform 1608 represents a current 1270 that flows through the inductor 1208 as a function of time.

According to one embodiment, when the system temperature is below the threshold (e.g., $T_{BK2}$ as shown in FIG. 9(A)), the system 1200 operates in a normal QR mode in which the temperature control mechanism is not activated. For example, a drive current (e.g., the average of the output current 1260 that flows through the one or more LEDs 1212) is kept at a magnitude 1610 (e.g., $I_{LED_NOM2}$ as shown in FIG. 9(A)). As an example, when the drive signal 1236 is at a logic high level during an on-time period (e.g., between $t_{20}$ and $t_{21}$ as shown by the waveform 1602), the switch 1228 is closed (e.g., being turned on), and the voltage signal 1240 (e.g., $V_{sense}$) increases in magnitude (e.g., to a magnitude 1612 at $t_{21}$) as shown by the waveform 1606. In another example, the current 1270 increases in magnitude (e.g., from below the magnitude 1610 to a magnitude 1660 that is larger than the magnitude 1610) as shown by the waveform 1608. In yet another example, the voltage signal 1248 (e.g., $V_{DRAIN}$) keeps at a low magnitude 1614 (e.g., as shown by the waveform 1604). As an example, the magnitude 1612 corresponds to the threshold signal 1254 (e.g., $V_{th_OCP}$).

According to another embodiment, when the drive signal 1236 changes from the logic high level to a logic low level (e.g., at $t_{21}$) as shown by the waveform 1602, the switch 1228 is opened (e.g., being turned off). For example, the voltage signal 1240 (e.g., $V_{sense}$) decreases rapidly to a low magnitude 1618 (e.g., 0) as shown by the waveform 1606. In another example, the current 1270 that flows through the inductor 1208 begins to decrease in magnitude (e.g., as shown by the waveform 1608). In yet another example, the voltage signal 1248 (e.g., $V_{DRAIN}$) increases rapidly in magnitude (e.g., from the low magnitude 1614 to a magnitude 1616) as shown by the waveform 1604.

According to yet another embodiment, during a demagnetization period (e.g., $T_{DEM}$) associated with a demagnetization process of the inductor 1208 (e.g., between $t_{21}$ and $t_{23}$), the drive signal 1236 is kept at the logic low level (e.g., as shown by the waveform 1602), and the switch 1228 is kept open (e.g., being off). For example, the voltage signal 1240 (e.g., $V_{sense}$) keeps at the low magnitude 1618 (e.g., 0) as shown by the waveform 1606. In another example, the current 1270 that flows through the inductor 1208 decreases in magnitude (e.g., from the magnitude 1660 to a magnitude 1662 that is smaller than the magnitude 1610) as shown by the waveform 1608. In yet another example, the voltage signal 1248 (e.g., $V_{DRAIN}$) keeps at the magnitude 1616 between $t_{21}$ and $t_{22}$ and then decreases in magnitude between $t_{22}$ and $t_{23}$. In yet another example, the demagnetization period (e.g., $T_{DEM}$) is equal in duration to an off-time period.

According to yet another embodiment, at the beginning of a next on-time period (e.g., $t_{23}$), the drive signal 1236 changes from the logic low level to the logic high level (e.g., as shown by the waveform 1602), and the switch 1228 is closed (e.g., being turned on). For example, the voltage signal 1240 (e.g., $V_{sense}$) increases in magnitude (e.g., as shown by the waveform 1606). In another example, the current 1270 begins to increase in magnitude (e.g., as shown by the waveform 1608). In yet another example, the voltage signal 1248 (e.g., $V_{DRAIN}$) decreases rapidly in magnitude (e.g., to the magnitude 1614) as shown by the waveform 1604.

Figure 10B:
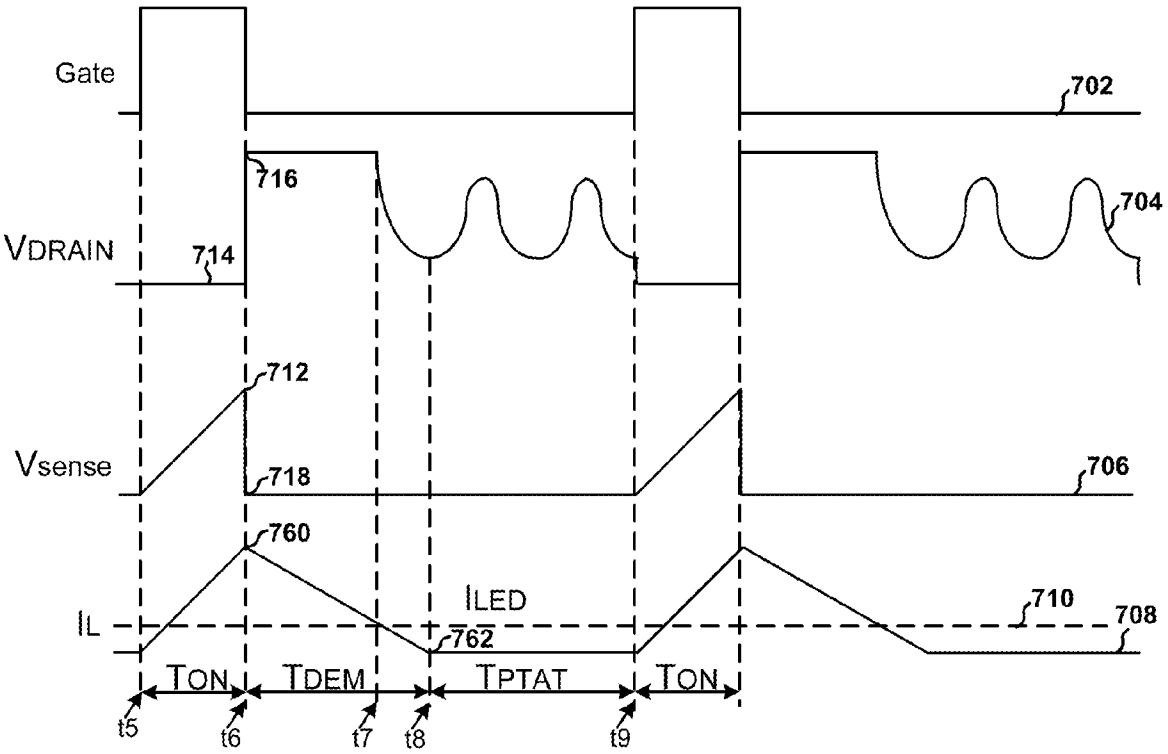
FIG. 10(B) is a simplified timing diagram if the temperature of the system controller exceeds a threshold for the system as shown in FIG. 8 according to one embodiment of the present invention.

FIG. 10(B) is a simplified timing diagram if the temperature of the system controller 1202 exceeds a threshold for the system 1200 according to one embodiment of the present invention. This diagram is merely an example, which should not unduly limit the scope of the claims. One of ordinary skill in the art would recognize many variations, alternatives, and modifications. As shown in FIG. 10(B), the waveform 702 represents the drive signal 1236 as a function of time, the waveform 704 represents the voltage signal 1248 (e.g., $V_{DRAIN}$) as a function of time, the waveform 706 represents the voltage signal 1240 (e.g., $V_{sense}$) as a function of time, and the waveform 708 represents the current 1270 that flows through the inductor 1208 as a function of time.

According to one embodiment, when the system temperature exceeds the threshold (e.g., $T_{BK2}$ as shown in FIG. 9(A)), the system 1200 operates in a temperature control mode in which the temperature control mechanism is activated. For example, the drive current (e.g., the average of the output current 1260 that flows through the one or more LEDs 1212) corresponds to a magnitude 710. As an example, when the drive signal 1236 is at a logic high level during an on-time period (e.g., between $t_5$ and $t_6$ as shown by the waveform 702), the switch 1228 is closed (e.g., being turned on), and the voltage signal 1240 (e.g., $V_{sense}$) increases in magnitude (e.g., to a magnitude 712 at $t_6$) as shown by the waveform 706. In another example, the current 1270 increases in magnitude (e.g., from below the magnitude 710 to a magnitude 760 that is larger than the magnitude 710) as shown by the waveform 708. In yet another example, the voltage signal 1248 (e.g., $V_{DRAIN}$) keeps at a low magnitude 714 (e.g., as shown by the waveform 704).

According to another embodiment, when the drive signal 1236 changes from the logic high level to a logic low level (e.g., at $t_6$) as shown by the waveform 702, the switch 1228 is opened (e.g., being turned off). For example, the voltage signal 1240 (e.g., $V_{sense}$) decreases rapidly to a low magnitude 718 (e.g., 0) as shown by the waveform 706. In another example, the current 1270 begins to decrease in magnitude (e.g., as shown by the waveform 708). In yet another example, the voltage signal 1248 (e.g., $V_{DRAIN}$) increases rapidly in magnitude (e.g., from the low magnitude 714 to a magnitude 716) as shown by the waveform 704.

According to yet another embodiment, during a demagnetization period (e.g., $T_{DEM}$) associated with a demagnetization process of the inductor 1208 (e.g., between $t_6$ and $t_8$), the drive signal 1236 is kept at the logic low level (e.g., as shown by the waveform 702), and the switch 1228 is kept open (e.g., being off). For example, the voltage signal 1240 (e.g., $V_{sense}$) keeps at the low magnitude 718 (e.g., 0) as shown by the waveform 706. In another example, the current 1270 decreases in magnitude (e.g., from the magnitude 760 to a magnitude 762 that is smaller than the magnitude 710) as shown by the waveform 708. In yet another example, the voltage signal 1248 (e.g., $V_{DRAIN}$) keeps at the magnitude 716 between $t_6$ and $t_7$ and then decreases in magnitude between $t_7$ and $t_8$.

In one embodiment, during an adjustment period (e.g., $T_{PTAT}$) between $t_8$ and $t_9$, the drive signal 1236 is kept at the logic low level (e.g., as shown by the waveform 702), and the switch 1228 is kept open (e.g., being off). For example, the voltage signal 1240 (e.g., $V_{sense}$) keeps at the low magnitude 718 (e.g., 0) as shown by the waveform 706. In another example, the current 1270 keeps at the magnitude 762 (e.g., as shown by the waveform 702). In yet another example, an off-time period is equal in magnitude to a sum of the demagnetization period (e.g., $T_{DEM}$) and the adjustment period (e.g., $T_{PTAT}$).

In another embodiment, at the beginning of a next on-time period (e.g., $t_9$), the drive signal 1236 changes from the logic low level to the logic high level (e.g., as shown by the waveform 702), and the switch 1228 is closed (e.g., being turned on). For example, the voltage signal 1240 (e.g., $V_{sense}$) increases in magnitude (e.g., as shown by the waveform 706). In another example, the current 1270 begins to increase in magnitude (e.g., as shown by the waveform 708). In yet another example, the voltage signal 1248 (e.g., $V_{DRAIN}$) decreases rapidly in magnitude (e.g., to the magnitude 714) as shown by the waveform 704.

Figure 11:
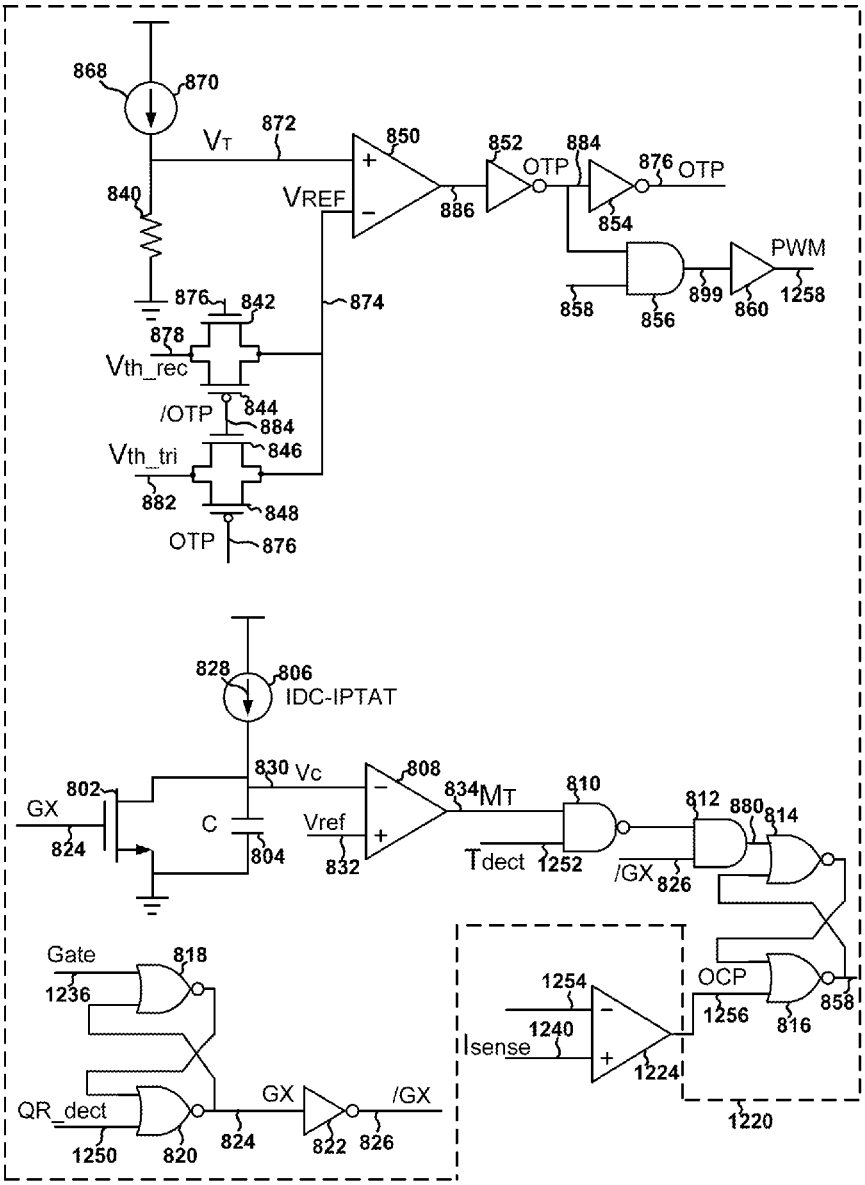
FIG. 11 is a simplified diagram showing certain components of a system controller as part of the system as shown in FIG. 8 according to one embodiment of the present invention.

FIG. 11 is a simplified diagram showing certain components of the system controller 1202 as part of the system 1200 according to one embodiment of the present invention. This diagram is merely an example, which should not unduly limit the scope of the claims. One of ordinary skill in the art would recognize many variations, alternatives, and modifications. As shown in FIG. 11, the modulation component 1220 includes a transistor 802, a capacitor 804, a current source component 806, a comparator 808, an NAND gate 810, an AND gate 812, NOR gates 814, 816, 818 and 820, and an NOT gate 822. The modulation component 1220 further includes N-channel transistors 842 and 846, P-channel transistors 844 and 848, a resistor 840, a comparator 850, NOT gates 852 and 854, an AND gate 856, a buffer 860, and a current source component 868.

According to one embodiment, the NOR gates 818 and 820 generate a signal 824 (e.g., GX) based at least in part on the drive signal 1236 and the operation-mode detection signal 1250. For example, the NOT gate 822 generates a signal 826 (e.g., /GX) that is complementary to the signal 824. As an example, the transistor 802 receives the signal 824 (e.g., GX) at a gate terminal, and is closed or opened in response to the signal 824. As another example, the capacitor 804 is charged in response to a temperature-related current 828 associated with the current source component 806 based at least in part on the status of the transistor 802, and a voltage signal 830 (e.g., $V_C$) is generated. In another example, the comparator 808 receives the voltage signal 830 and a reference signal 832 and generates a comparison signal 834 (e.g., $M_T$). As an example, the voltage signal 830 is a ramp signal that increases in magnitude during a ramp-up time period. As another example, the current 828 is determined as follows:

$$I_C = I_{DC} - I_{PTAT} \tag{17}$$

where $I_C$ represents the current 828, $I_{DC}$ represents a constant current, and $I_{PTAT}$ represents an adjustment current changing with the temperature of the system controller 1202.

According to another embodiment, if the system temperature T is smaller than a threshold (e.g., $T_{BK2}$ as shown in FIG. 9(A)), the thermal detection signal 1252 (e.g., $T_{dect}$) generated by the thermal detector 1218 is kept at a logic low level (e.g., 0) to mask the comparison signal 834 (e.g., $M_T$). For example, if the operation-mode detection component 1222 detects a valley (e.g., a low magnitude) in the voltage signal 1248 (e.g., $V_{DRAIN}$), the operation-mode detection component 1222 changes the detection signal 1250 (e.g., QR_dect) to set the signal 826 (e.g., /GX) to a logic high level (e.g., 1). The system 1200 operates in a normal QR mode in which the temperature control mechanism is not activated, according to some embodiments. For example, a demagnetization period associated with the inductor 1208 is equal in duration to an off-time period in which the switch 1228 is opened (e.g., being turned off).

According to yet another embodiment, if the system temperature T is larger than the threshold (e.g., $T_{BK2}$ as shown in FIG. 9(A)), the thermal detector 1218 changes the detection signal 1252 (e.g., $T_{dect}$) to a logic high level (e.g., "1"). For example, the off-time period increases in duration to be equal to a sum of the demagnetization period and an adjustment period (e.g., $T_{PTAT}$). As an example, the comparator 1224 receives the threshold signal 1254 (e.g., $V_{th_OCP}$) and the signal 1240 (e.g., $V_{sense}$) and outputs the protection signal 1256 to the NOR gate 816. As another example, the threshold signal 1254 (e.g., $V_{th_OCP}$) does not change with temperature of the system controller 1202.

In one embodiment, the adjustment period (e.g., $T_{PTAT}$) is determined as follows:

$$T_{PTAT} = \frac{V_{ref} * C}{I_{DC} - I_{PTAT}} \tag{18}$$

where $V_{ref}$ represents the reference signal 832, $I_{DC}$ represents the constant current, $I_{PTAT}$ represents the adjustment current changing with temperature of the system controller 1202, and C represents the capacitance of the capacitor 804. For example, based on Equations (10), (12) and (18), a drive current $I_{LED}$ (e.g., an average of the output current 1260) is determined as follows:

$$I_{LED} = 0.5 * \frac{V_{th_ocp}}{R_s} * \left\{1 - \frac{V_{ref} * C}{(T_{on} + T_{DEM}) * (I_{DC} - K * T) + V_{ref} * C}\right\} \tag{19}$$

where $I_{LED}$ represents the drive current, $T_{on}$ represents the on-time period during which the switch 1228 is being turned on, $T_{DEM}$ represents a demagnetization period associated with a demagnetization process of the system 1200, $V_{th_ocp}$ represents the threshold signal 1254, and $R_s$ represents the resistance of the resistor 1204. According to Equation (19), the drive current changes non-linearly with temperature (e.g., as shown in FIG. 9(A)), according to certain embodiments.

In another embodiment, the NOR gate 816 which receives the protection signal 1256 (e.g., OCP) operates with the NOR gate 814 which receives a signal 880 from the AND gate 812 and generates a signal 858 to the AND gate 856. In another example, the current source component 868 generates a current 870 (e.g., $I_{PTAT}$), and the resistor 840 provides a voltage signal 872 (e.g., $V_T$). As an example, the current 870 is proportional in magnitude to a temperature of the system controller 1202. As another example, the comparator 850 receives the voltage signal 872 and a reference signal 874 and generates a comparison signal 886 to the NOT gate 852 which outputs a signal 884 (e.g., /OTP) to the NOT gate 854. In another example, the NOT gate 854 outputs a signal 876 (e.g., OTP) in response to the signal 884. In yet another example, the AND gate 856 receives the signal 884 and the signal 858 and the buffer 860 outputs the modulation signal 1258 (e.g., PWM).

In one embodiment, the transistors 842 and 848 receive the signal 876 (e.g., OTP) at their gate terminals, and the transistors 844 and 846 receive the signal 884 (e.g., /OTP) at their gate terminals. For example, a threshold voltage 878 (e.g., $V_{th_rec}$) is provided to the transistors 842 and 844 at their source/drain terminals, and another threshold voltage 882 (e.g., $V_{th_tri}$) is provided to the transistors 846 and 848 at their source/drain terminals. In another example, the transistors 842, 844, 846 and 848 are configured to provide the reference signal 874 to the comparator 850.

In another embodiment, if the signal 876 (e.g., OTP) is set to a logic low level (e.g., "0") and the signal 884 (e.g., /OTP) is set to a logic high level (e.g., "1"), the transistors 842 and 844 are opened (e.g., being turned off), and the transistors 846 and 848 are closed (e.g., being turned on). As an example, the reference signal 874 (e.g., $V_{REF}$) is approximately equal in magnitude to the threshold voltage 882 (e.g., $V_{th_tri}$). For example, if the temperature of the system controller 1202 increases to become larger than the temperature threshold $T_{Tri2}$ (e.g., as shown in FIG. 9(A)), the signal 872 (e.g., $V_T$) increases to become larger in magnitude than the reference signal 874 (e.g., $V_{REF}$) which is approximately equal in magnitude to the threshold voltage 882 (e.g., $V_{th_tri}$), and the comparator 850 outputs the comparison signal 886 at the logic high level (e.g., "1"). In response, the signal 884 (e.g., /OTP) changes to the logic low level (e.g., "0") and the signal 876 (e.g., OTP) changes to the logic high level (e.g., "1"). In yet another example, the AND gate 856 outputs a signal 899 at the logic low level (e.g., "0") regardless of the value of the signal 858, and the modulation signal 1258 (e.g., PWM) is also at the logic low level. As an example, the driving component 1226 outputs the drive signal 1236 at the logic low level (e.g., "0"), and in response the switch 1228 is opened (e.g., being turned off). As another example, the switch 1228 remains open for a period of time, and normal operations of the system 1200 are stopped.

As the signal 884 (e.g., /OTP) changes to the logic low level (e.g., "0") and the signal 876 (e.g., OTP) changes to the logic high level (e.g., "1"), the transistors 842 and 844 are closed (e.g., being turned on), and the transistors 846 and 848 are opened (e.g., being turned off), according to certain embodiments. For example, the reference signal 874 (e.g., $V_{REF}$) is approximately equal in magnitude to the threshold voltage 878 (e.g., $V_{th_rec}$). In another example, if the temperature of the system controller 1202 decreases to become smaller than the temperature threshold $T_{rec2}$ (e.g., as shown in FIG. 9(A)), the signal 872 (e.g., $V_T$) becomes smaller in magnitude than the reference signal 874 (e.g., $V_{REF}$) which is approximately equal in magnitude to the threshold voltage 878 (e.g., $V_{th_rec}$), and the comparator 850 outputs the comparison signal 886 at the logic low level (e.g., "0"). In response, the signal 884 (e.g., /OTP) changes to the logic high level (e.g., "1") and the signal 876 (e.g., OTP) changes to the logic low level (e.g., "0"). In yet another example, the AND gate 856 generates the signal 899 in response to the signal 884 (e.g., /OTP) and the signal 858. As an example, the driving component 1226 outputs the drive signal 1236 to close and open the switch 1228, and the system 1200 performs normal operations. As the signal 884 (e.g., /OTP) changes to the logic high level (e.g., "1") and the signal 876 (e.g., OTP) changes to the logic low level (e.g., "0"), the transistors 842 and 844 are opened (e.g., being turned off), and the transistors 846 and 848 are closed (e.g., being turned on), according to some embodiments. As an example, the reference signal 874 (e.g., $V_{REF}$) becomes approximately equal in magnitude to the threshold voltage 882 (e.g., $V_{th_tri}$) again.

Figure 12:
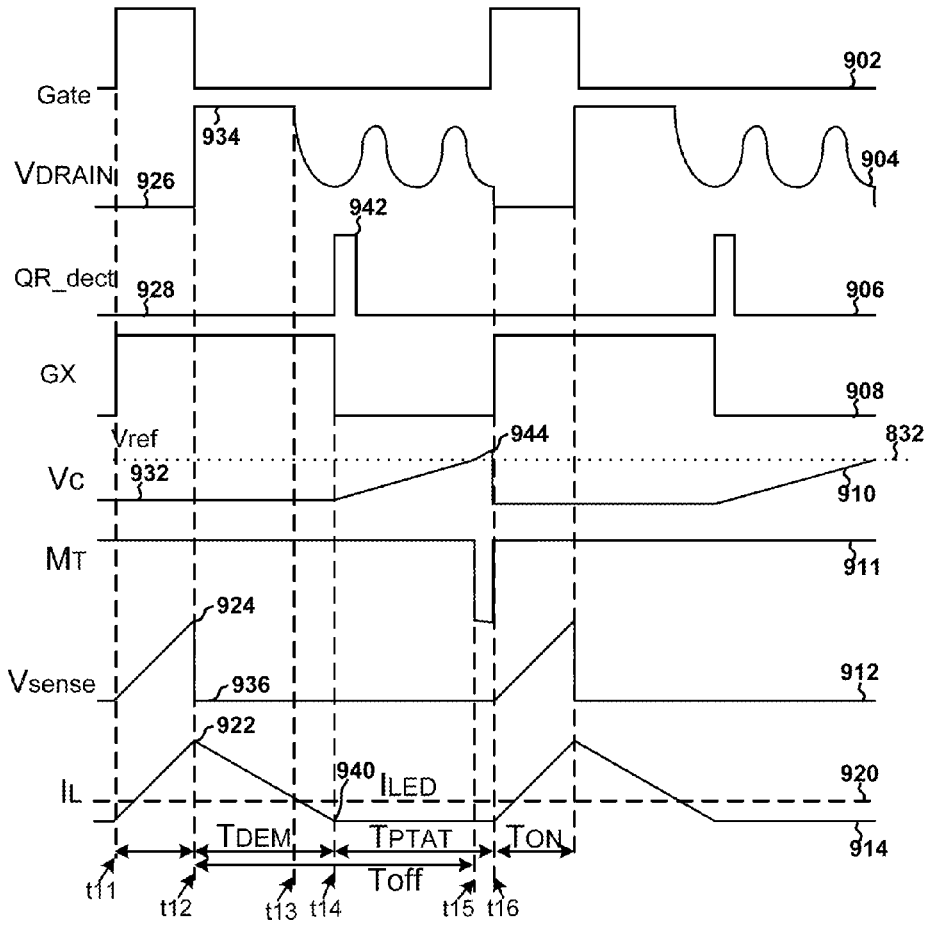
FIG. 12 is a simplified timing diagram for certain components of the system controller as shown in FIG. 11 according to one embodiment of the present invention.

FIG. 12 is a simplified timing diagram for certain components of the system controller 1202 as shown in FIG. 11 according to one embodiment of the present invention. This diagram is merely an example, which should not unduly limit the scope of the claims. One of ordinary skill in the art would recognize many variations, alternatives, and modifications.

As shown in FIG. 12, the waveform 902 represents the drive signal 1236 as a function of time, the waveform 904 represents the voltage signal 1248 (e.g., $V_{DRAIN}$) as a function of time, the waveform 911 represents the comparison signal 1834 (e.g., $M_T$) as a function of time, the waveform 912 represents the voltage signal 1240 (e.g., $V_{sense}$) as a function of time, and the waveform 914 represents the current 1270 that flows through the inductor 1208 as a function of time. In addition, the waveform 906 represents the detection signal 1250 (e.g., QR_dect) as a function of time, the waveform 908 represents the signal 1824 (e.g., GX) as a function of time, and the waveform 910 represents the voltage signal 1830 (e.g., $V_C$) as a function of time. For example, the waveforms 902, 904, 912, and 914 are the same as the waveforms 702, 704, 706, and 708 respectively.

According to one embodiment, the drive current (e.g., the average of the output current 1260 that flows through the one or more LEDs 1212) corresponds to a magnitude 920. As an example, when the drive signal 1236 is at a logic high level during an on-time period $T_{on}$ (e.g., between $t_{11}$ and $t_{12}$ as shown by the waveform 902), the switch 1228 is closed (e.g., being turned on), and the voltage signal 1240 (e.g., $V_{sense}$) increases in magnitude (e.g., to a magnitude 924 at $t_{12}$) as shown by the waveform 912. In another example, the current 1270 increases in magnitude (e.g., from below the magnitude 920 to a magnitude 922 that is larger than the magnitude 920) as shown by the waveform 914. In yet another example, the voltage signal 1248 (e.g., $V_{DRAIN}$) keeps at a low magnitude 926 (e.g., as shown by the waveform 904). In yet another example, the detection signal 1250 (e.g., QR_dect) keeps at a low magnitude 928 (e.g., 0) during the on-time period $T_{on}$ (e.g., between $t_{11}$ and $t_{12}$ as shown by the waveform 906). The signal 1824 (e.g., GX) keeps at a logic high level (e.g., as shown by the waveform 908), and in response the voltage signal 1830 (e.g., $V_C$) keeps at a magnitude 932 smaller than the reference voltage 1832 (e.g., as shown by the waveform 910). The comparison signal 1834 (e.g., $M_T$) keeps at a logic high level during the on-time period $T_{on}$ (e.g., between $t_{11}$ and $t_{12}$ as shown by the waveform 911).

According to another embodiment, at the beginning of a demagnetization period (e.g., at $t_{12}$), the drive signal 1236 changes to a logic low level (e.g., as shown by the waveform 902), and the switch 1228 is opened (e.g., being turned off). For example, the voltage signal 1240 (e.g., $V_{sense}$) decreases rapidly to a low magnitude 936 (e.g., 0) as shown by the waveform 912. In another example, the current 1270 begins to decrease in magnitude (e.g., as shown by the waveform 914). In yet another example, the voltage signal 1248 (e.g., $V_{DRAIN}$) increases rapidly in magnitude (e.g., from the low magnitude 926 to a magnitude 934) as shown by the waveform 904.

According to yet another embodiment, during a demagnetization period (e.g., $T_{DEM}$) associated with a demagnetization process of the inductor 1208 (e.g., between $t_{12}$ and $t_{14}$), the drive signal 1236 is kept at the logic low level (e.g., as shown by the waveform 902), and the switch 1228 is kept open (e.g., being off). For example, the voltage signal 1240 (e.g., $V_{sense}$) keeps at the low magnitude 936 (e.g., 0) as shown by the waveform 912. In another example, the current 1270 decreases in magnitude (e.g., from the magnitude 922 to a magnitude 940 that is smaller than the magnitude 920) as shown by the waveform 914. In yet another example, the voltage signal 1248 (e.g., $V_{DRAIN}$) keeps at the magnitude 934 between $t_{12}$ and $t_{13}$ and then decreases in magnitude between $t_{13}$ and $t_{14}$. In yet another example, during the demagnetization period (e.g., $T_{DEM}$), the detection signal 1250 keeps at the log magnitude 928 (e.g., as shown by the waveform 906). In yet another example, The signal 1824 (e.g., GX) keeps at the logic high level (e.g., as shown by the waveform 908), and in response the voltage signal 1830 (e.g., $V_C$) keeps at the magnitude 932 (e.g., as shown by the waveform 910). The comparison signal 1834 (e.g., $M_T$) keeps at the logic high level during the demagnetization period $T_{DEM}$ (e.g., between $t_{12}$ and $t_{14}$ as shown by the waveform 911).

In one embodiment, at the beginning of an adjustment period $T_{PTAT}$ (e.g., at $t_{14}$), the operation-mode detection component 1222 detects a first valley in the voltage signal 1248 (e.g., as shown by the waveform 904), and generates a pulse 942 in the detection signal 1250 (e.g., as shown by the waveform 906). For example, the signal 1824 (e.g., GX) changes to a logic low level (e.g., as shown by the waveform 908). In another example, the voltage signal 1830 (e.g., $V_C$) begins to increase in magnitude (e.g., as shown by the waveform 910).

In another embodiment, during the adjustment period $T_{PTAT}$ (e.g., between $t_{14}$ and $t_{15}$), the drive signal 1236 is kept at the logic low level (e.g., as shown by the waveform 902). For example, the signal 1824 (e.g., GX) keeps at the logic low level (e.g., as shown by the waveform 908). In another example, the voltage signal 1830 (e.g., $V_C$) increases in magnitude (e.g., as shown by the waveform 910). In yet another example, at $t_{15}$, the voltage signal 1830 changes from lower than the reference voltage 1832 to higher than the reference voltage 1832, and the comparison signal 1834 (e.g., $M_T$) changes from the logic high level to the logic low level. In response the drive signal 1236 changes from the logic low level to the logic high level after a short delay (e.g., between $t_{15}$ and $t_{16}$), according to some embodiments. The drive signal 1236 changes from the logic low level to the logic high level immediately without delay, according to certain embodiments. For example, once the drive signal 1236 changes from the logic low level to the logic high level, a next on-time period begins.

Figure 13A:
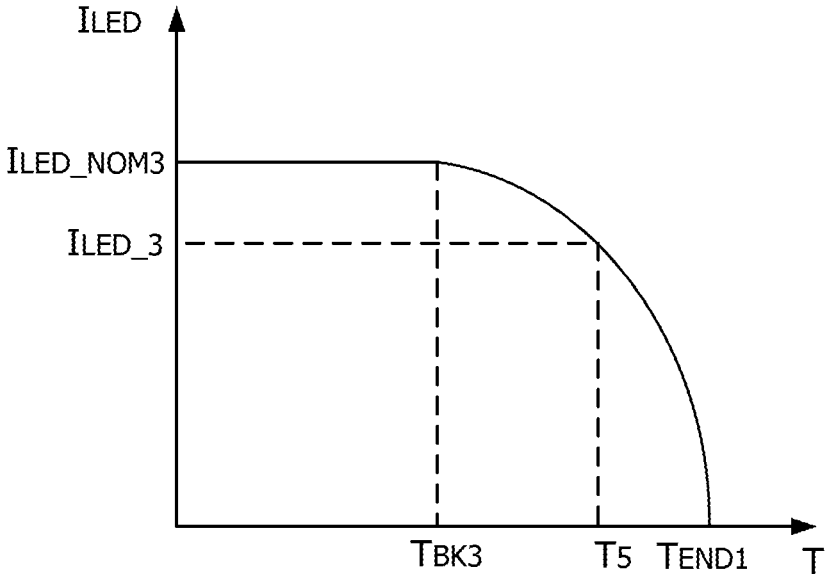
FIG. 13(A) is a simplified diagram showing a relationship of a drive current associated with the one or more LEDs and the temperature of the system controller as shown in FIG. 8 for temperature control according to another embodiment of the present invention.

FIG. 13(A) is a simplified diagram showing a relationship of a drive current associated with the one or more LEDs 1212 and the temperature of the system controller 1202 for temperature control according to another embodiment of the present invention. This diagram is merely an example, which should not unduly limit the scope of the claims. One of ordinary skill in the art would recognize many variations, alternatives, and modifications.

As shown in FIG. 13(A), the system controller 1202 changes the drive current (e.g., the average of the output current 1260 that flows through the one or more LEDs 1212)

with the temperature, according to some embodiments. For example, the drive current (e.g., $I_{LED}$) keeps at a magnitude (e.g., $I_{LED_NOM3}$) if the temperature of the system controller 1202 is smaller than a temperature threshold (e.g., $T_{BK3}$). In another example, if the temperature of the system controller 1202 exceeds the temperature threshold (e.g., $T_{BK3}$), the system controller 1202 decreases the drive current in order to reduce the temperature of the system controller 1202. In some embodiments, the drive current changes in magnitude non-linearly with the temperature of the system controller 1202 in a range between the temperature threshold $T_{BK3}$ and a temperature magnitude $T_{END1}$. In some embodiments, according to the exponential function, the drive current is determined, in the range between the temperature threshold $T_{BK3}$ and the temperature magnitude $T_{END1}$, as follows:

$$I_{LED}=k-p*e^{qT} \tag{20}$$

where k, p, and q are parameters not affected by temperature. For example, k, p, and q are positive parameters not affected by temperature. In another example, the drive current is determined using an approximation technique (e.g., Taylor series) for the exponential function.

According to one embodiment, if the temperature of the system controller 1202 increases to a temperature magnitude $T_5$ (e.g., smaller than the temperature magnitude $T_{END1}$), the system controller 1202 reduces the drive current to a current magnitude $L_{LED_3}$. For example, if the temperature of the system controller 1202 reaches the magnitude $T_{END1}$, the drive current decreases to a low magnitude (e.g., 0). In another example, the system controller 1202 stops normal operations. In yet another example, the system controller 1202 reduces the drive current faster in the temperature range between $T_5$ and $T_{END1}$ than in the temperature range between $T_{BK3}$ and $T_5$.

Figure 13B:
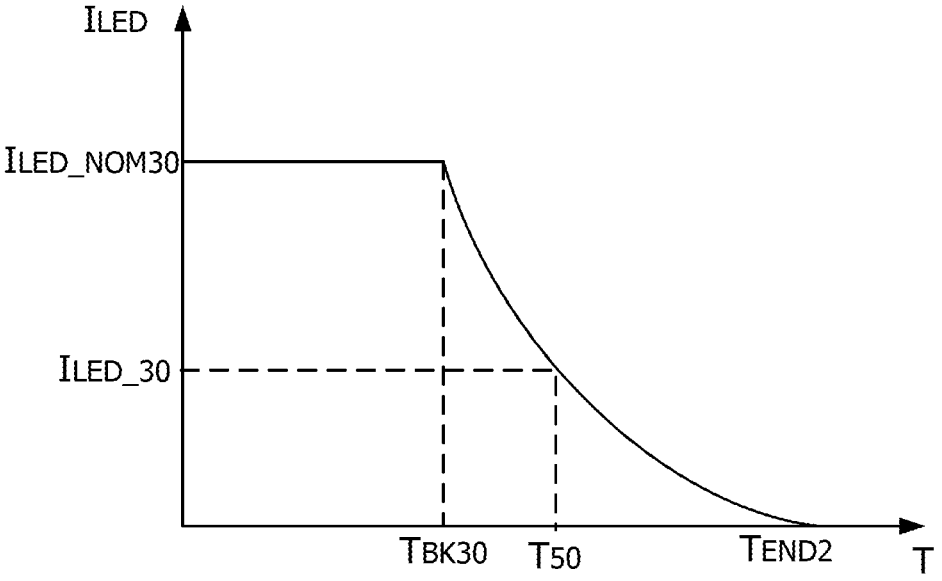
FIG. 13(B) is a simplified diagram showing a relationship of a drive current associated with the one or more LEDs and the temperature of the system controller as shown in FIG. 8 for temperature control according to yet another embodiment of the present invention.

FIG. 13(B) is a simplified diagram showing a relationship of a drive current associated with the one or more LEDs 1212 and the temperature of the system controller 1202 for temperature control according to yet another embodiment of the present invention. This diagram is merely an example, which should not unduly limit the scope of the claims. One of ordinary skill in the art would recognize many variations, alternatives, and modifications.

As shown in FIG. 13(B), the system controller 1202 changes the drive current (e.g., the average of the output current 1260 that flows through the one or more LEDs 1212) with the temperature, according to some embodiments. For example, the drive current (e.g., $I_{LED}$) keeps at a magnitude (e.g., $I_{LED_NOM30}$) if the temperature of the system controller 1202 is smaller than a temperature threshold (e.g., $T_{BK30}$). In another example, if the temperature of the system controller 1202 exceeds the temperature threshold (e.g., $T_{BK30}$), the system controller 1202 decreases the drive current in order to reduce the temperature of the system controller 1202. In some embodiments, the drive current changes in magnitude non-linearly with the temperature of the system controller 1202 in a range between the temperature threshold $T_{BK30}$ and a temperature magnitude $T_{END2}$. As an example, the drive current changes approximately according to an exponential function of the temperature of the system controller 1202 in the range between the temperature threshold $T_{BK30}$ and the temperature magnitude $T_{END2}$. In some embodiments, according to the exponential function, the drive current is determined, in the range between the temperature threshold $T_{BK30}$ and the temperature magnitude $T_{END2}$, as follows:

$$I_{LED}=f+g*e^{-hT} \tag{21}$$

where f, g, and h are parameters not affected by temperature. For example, f, g, and h are positive parameters not affected by temperature. In another example, the drive current is determined using an approximation technique (e.g., Taylor series) for the exponential function.

According to one embodiment, if the temperature of the system controller 1202 increases to a temperature magnitude $T_{50}$ (e.g., smaller than the temperature magnitude $T_{END2}$), the system controller 1202 reduces the drive current to a current magnitude $I_{LED_30}$. For example, if the temperature of the system controller 1202 reaches the magnitude $T_{END2}$, the drive current decreases to a low magnitude (e.g., 0). In another example, the system controller 1202 stops normal operations. In yet another example, the system controller 1202 reduces the drive current slower in the temperature range between $T_{50}$ and $T_{END2}$ than in the temperature range between $T_{BK30}$ and $T_{50}$.

Different applications of LED lighting systems often have different requirements for LED brightness (e.g., corresponding to different LED drive currents). For example, different lower current limits (e.g., $I_{LED_min1}$ as shown in FIG. 3, or $I_{LED_min2}$ as shown in FIG. 9(A)) are implemented for different LED applications.

Figure 14:
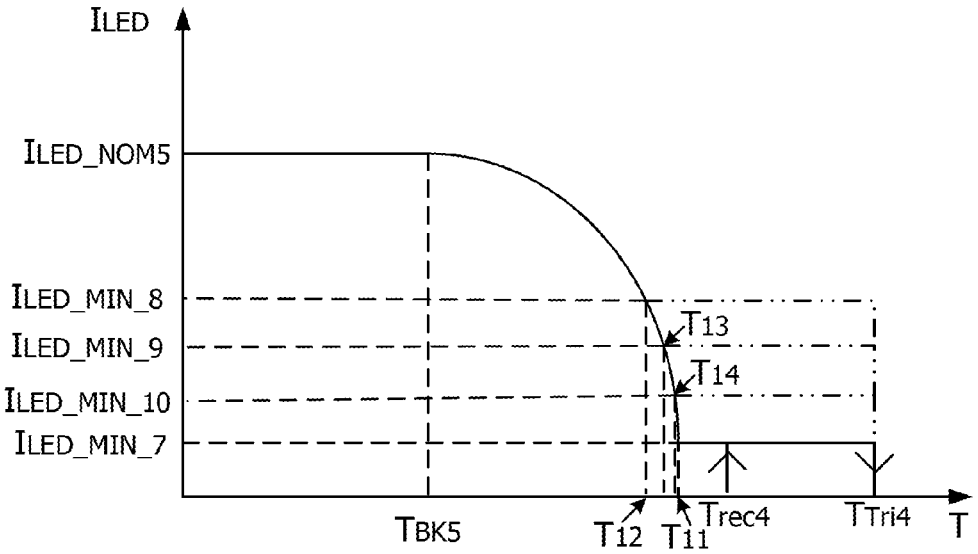
FIG. 14 is a simplified diagram showing adjustment of a lower current limit associated with the one or more LEDs as shown in FIG. 8 for temperature control according to another embodiment of the present invention.

FIG. 14 is a simplified diagram showing adjustment of a lower current limit associated with the one or more LEDs 1212 for temperature control according to another embodiment of the present invention. This diagram is merely an example, which should not unduly limit the scope of the claims. One of ordinary skill in the art would recognize many variations, alternatives, and modifications.

According to some embodiments, the system controller 1202 adjusts a upper duration limit of an off-time period ($T_{off_max}$) to determine a lower current limit (e.g., according to Equations (12) and (13)), according to some embodiments. For example, according to Equations (12) and (13), the duration of the off-time period is changes with temperature. As an example, if the duration of the off-time period becomes larger than the upper duration limit ($T_{off_max}$), the system controller 1202 operates to change the duration of the off-time period to be equal to the upper duration limit ($T_{off_max}$). As another example, the lower current limit is determined (e.g., within a range) based at least in part on the adjustment of the upper duration limit of the off-time period ($T_{off_max}$). Referring back to FIG. 9(A) and/or FIG. 9(B), the lower current limit (e.g., $I_{LED_min2}$ or $I_{LED_min13}$) can be changed by adjusting the upper duration limit of the off-time period, according to certain embodiments.

As shown in FIG. 14, the system controller 1202 changes the drive current (e.g., the average of the output current 1260 that flows through the one or more LEDs 1212) with the temperature, according to some embodiments. For example, the drive current (e.g., $I_{LED}$) keeps at a magnitude (e.g., $I_{LED_NOM5}$) if the temperature of the system controller 1202 is smaller than a temperature threshold (e.g., $T_{BK5}$). In another example, if the temperature of the system controller 1202 exceeds the temperature threshold (e.g., $T_{BK5}$), the system controller 1202 decreases the drive current in order to reduce the temperature of the system controller 1202. As an example, the drive current changes in magnitude non-linearly with the temperature of the system controller 1202 in a range between the temperature threshold $T_{BK5}$ and a temperature magnitude $T_{11}$. In another example, if the temperature of the system controller 1202 reaches the magnitude $T_{11}$, the drive current decreases to a lower current limit (e.g., $I_{LED_min7}$). In yet another example, the system controller 1202 keeps the drive current approximately equal in magnitude to the lower current limit (e.g., $I_{LED_min7}$) in a range between the temperature magnitude $T_{11}$ and another temperature threshold $T_{Tri4}$. In yet another example, if the temperature of the system controller 1202 increases to become equal to or larger than the temperature threshold $T_{Tri4}$, the system controller 1202 decreases the drive current to a low magnitude (e.g., 0). In yet another example, the system controller 1202 stops normal operation.

According to one embodiment, if the temperature of the system controller 1202 decreases to become equal to or larger than another temperature threshold $T_{rec4}$, the system controller 1202 begins operation again. For example, the system controller 1202 keeps the drive current at the lower current limit (e.g., $I_{LED_min7}$) in a range between the temperature threshold $T_{rec4}$ and the temperature magnitude $T_{11}$. In another example, the drive current changes in magnitude non-linearly with the temperature of the system controller 1202 in a range between the temperature threshold $T_{BK5}$ and the temperature magnitude $T_{11}$. In yet another example, if the temperature of the system controller 1202 decreases to below the temperature threshold $T_{BK5}$, the system controller 1202 keeps the drive current at the current threshold $I_{LED_NOM5}$.

According to another embodiment, if the lower current limit changes from $I_{LED_min7}$ to $I_{LED_min8}$, the temperature at which the drive current changes to the corresponding lower current limit changes from $T_{11}$ to $T_{12}$. For example, if the lower current limit changes $I_{LED_min9}$, the temperature at which the drive current changes to the corresponding lower current limit changes to $T_{13}$. In another example, if the lower current limit changes to $I_{LED_min10}$, the temperature at which the drive current changes to the corresponding lower current limit changes to $T_{14}$. As an example, $T_{12} \leq T_{13} \leq T_{14} \leq T_{11}$.

According to yet another embodiment, a system controller for regulating one or more currents includes: a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes. The modulation-and-driver component is further configured to: in response to the detected temperature increasing from a first temperature threshold but remaining smaller than a second temperature threshold, generate the drive signal to keep the drive current at a first current magnitude, the second temperature threshold being higher than the first temperature threshold; in response to the detected temperature increasing to become equal to or larger than the second temperature threshold, change the drive signal to reduce the drive current from the first current magnitude to a second current magnitude, the second current magnitude being smaller than the first current magnitude; in response to the detected temperature decreasing from the second temperature threshold but remaining larger than the first temperature threshold, generate the drive signal to keep the drive current at the second current magnitude; and in response to the detected temperature decreasing to become equal to or smaller than the first temperature threshold, change the drive signal to increase the drive current from the second current magnitude to the first current magnitude. For example, the system controller is implemented according to at least FIG. 3, FIG. 7, FIG. 9(A), FIG. 9(B) and/or FIG. 14.

According to another embodiment, a system controller for regulating one or more currents includes: a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes. The modulation-and-driver component is further configured to: in response to the detected temperature increasing to become larger than a first temperature threshold but remaining smaller than a second temperature threshold, change the drive signal to reduce the drive current approximately according to an exponential function of the detected temperature, the first temperature threshold being smaller than the second temperature threshold. For example, the system controller is implemented according to at least FIG. 9(A), FIG. 9(B), FIG. 13(A), FIG. 13(B), and/or FIG. 14.

According to yet another embodiment, a method for regulating one or more currents includes: detecting a temperature; generating a thermal detection signal based at least in part on the detected temperature; receiving the thermal detection signal; and generating a drive signal based at least in part on the thermal detection signal to close or open a switch to affect a drive current associated with one or more light emitting diodes. The generating the drive signal based at least in part on the thermal detection signal to close or open the switch to affect the drive current associated with the one or more light emitting diodes includes: in response to the detected temperature increasing from a first temperature threshold but remaining smaller than a second temperature threshold, generating the drive signal to keep the drive current at a first current magnitude, the second temperature threshold being higher than the first temperature threshold; in response to the detected temperature increasing to become equal to or larger than the second temperature threshold, changing the drive signal to reduce the drive current from the first current magnitude to a second current magnitude, the second current magnitude being smaller than the first current magnitude; in response to the detected temperature decreasing from the second temperature threshold but remaining larger than the first temperature threshold, generating the drive signal to keep the drive current at the second current magnitude; and in response to the detected temperature decreasing to become equal to or smaller than the first temperature threshold, changing the drive signal to increase the drive current from the second current magnitude to the first current magnitude. For example, the method is implemented according to at least FIG. 3, FIG. 7, FIG. 9(A), FIG. 9(B) and/or FIG. 14.

According to yet another embodiment, a method for regulating one or more currents includes: detecting a temperature; generating a thermal detection signal based at least in part on the detected temperature; receiving the thermal detection signal; and generating a drive signal based at least in part on the thermal detection signal to close or open a switch to affect a drive current associated with one or more light emitting diodes. The generating the drive signal based at least in part on the thermal detection signal to close or open the switch to affect the drive current associated with the one or more light emitting diodes includes: in response to the detected temperature increasing to become larger than a first temperature threshold but remaining smaller than a second temperature threshold, changing the drive signal to reduce the drive current approximately according to an exponential function of the detected temperature, the first temperature threshold being smaller than the second temperature threshold. For example, the method is implemented according to at least FIG. 9(A), FIG. 9(B), FIG. 13(A), FIG. 13(B), and/or FIG. 14.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system controller for regulating one or more currents, the system controller comprising:

a thermal detector configured to detect a temperature associated with the system controller and generate a thermal detection signal based at least in part on the detected temperature;

a modulation-and-driver component configured to receive the thermal detection signal and generate a drive signal based at least in part on the thermal detection signal to close or open a switch to affect a drive current associated with one or more light emitting diodes;

a first comparator configured to receive a first voltage signal and a current sensing signal and generate a first comparison signal based at least in part on the first voltage signal and the current sensing signal, the current sensing signal being associated with the drive current, the first voltage signal being associated with the thermal detection signal; and an operation-mode detection component configured to receive a second voltage signal associated with the drive current and generate a mode detection signal based at least in part on the second voltage signal;

wherein the modulation-and-driver component is further configured to:

in response to the detected temperature increasing from a first temperature threshold but remaining smaller than a second temperature threshold, generate the drive signal to keep the drive current at a first current magnitude, the second temperature threshold being higher than the first temperature threshold;

in response to the detected temperature increasing to become equal to or larger than the second temperature threshold, change the drive signal to reduce the drive current from the first current magnitude to a second current magnitude, the second current magnitude being smaller than the first current magnitude;

in response to the detected temperature decreasing from the second temperature threshold but remaining larger than the first temperature threshold, generate the drive signal to keep the drive current at the second current magnitude; and in response to the detected temperature decreasing to become equal to or smaller than the first temperature threshold, change the drive signal to increase the drive current from the second current magnitude to the first current magnitude; and receive the first comparison signal and the mode detection signal and generate the drive signal based at least in part on the first comparison signal and the mode detection signal.

2. The system controller of claim 1 wherein the modulation-and-driver component is further configured to:

in response to the detected temperature remaining smaller than a third temperature threshold, generate the drive signal to keep the drive current at a third current magnitude, the third temperature threshold being smaller than the first temperature threshold and the second temperature threshold; and in response to the detected temperature increasing to become larger than the third temperature threshold but remaining smaller than a fourth temperature threshold, change the drive signal to reduce the drive current from the third current magnitude, the fourth temperature threshold being larger than the third temperature threshold but smaller than or equal to the first temperature threshold.

3. The system controller of claim 2 wherein the fourth temperature threshold decreases with the first current magnitude increasing.

4. The system controller of claim 2 wherein the modulation-and-driver component is further configured to, in response to the detected temperature increasing to become larger than the third temperature threshold but remaining smaller than the fourth temperature threshold, change the drive signal to reduce linearly the drive current from the third current magnitude.

5. The system controller of claim 2 wherein the modulation-and-driver component is further configured to, in response to the detected temperature increasing to become larger than the third temperature threshold but remaining smaller than the fourth temperature threshold, change the drive signal to reduce non-linearly the drive current from the third current magnitude.

6. The system controller of claim 5 wherein the modulation-and-driver component is further configured to, in response to the detected temperature increasing to become larger than the third temperature threshold but remaining smaller than the fourth temperature threshold, change the drive signal to reduce the drive current approximately according to an exponential function of the detected temperature.

7. The system controller of claim 2 wherein the modulation-and-driver component is further configured to, in response to the detected temperature increasing to become larger than the fourth temperature threshold but remaining smaller than the second temperature threshold, change the drive signal to keep the drive current at the first current magnitude.

8. The system controller of claim 1, further comprising:

a summation component configured to generate the first voltage signal as a sum of a predetermined voltage and a third voltage signal, the third voltage signal being proportional to the detected temperature in magnitude.

9. The system controller of claim 8 wherein the summation component includes:

a current-generation component configured to provide a first current based at least in part on the detected temperature; and a resistor configured to receive the first current and generate the third voltage signal based at least in part on the first current.

10. The system controller of claim 1 wherein the modulation-and-driver component includes:

a modulation component configured to receive the thermal detection signal and generate a modulation signal based at least in part on the thermal detection signal; and a driver component configured to receive the modulation signal and output the drive signal based at least in part on the modulation signal.

11. The system controller of claim 10 wherein the modulation component includes:

a signal generator configured to receive the mode detection signal and the drive signal and generate a third voltage signal based at least in part on the mode detection signal and the drive signal;

a current-generation component configured to provide a first current based at least in part on the detected temperature;

a ramp signal generator configured to receive the first current and generate a fourth voltage signal based at least in part on the first current and the third voltage signal;

a second comparator configured to receive the fourth voltage signal and a reference signal and generate a second comparison signal based at least in part on the fourth voltage signal and the reference signal; and a logic-operation component configured to receive the second comparison signal and the thermal detection signal and generate the modulation signal based at least in part on the second comparison signal and the thermal detection signal.

12. The system controller of claim 11 wherein the ramp signal generator includes:

a transistor configured to close or open in response to the third voltage signal; and a capacitor configured to be charged by the first current in response to the transistor being open and generate the fourth voltage signal.

13. The system controller of claim 11 wherein the signal generator includes one or more NOR gates and one or more NOT gate.

14. The system controller of claim 11 wherein the logic-operation component includes one or more NAND gates, one or more NOR gates, and one or more AND gates.

15. The system controller of claim 1 wherein the second current magnitude is equal to zero.

16. A system controller for regulating one or more currents, the system controller comprising:

a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes;

wherein the modulation-and-driver component is further configured to:

in response to the detected temperature increasing from a first temperature threshold but remaining smaller than a second temperature threshold, generate the drive signal to keep the drive current at a first current magnitude, the second temperature threshold being higher than the first temperature threshold;

in response to the detected temperature increasing to become equal to or larger than the second temperature threshold, change the drive signal to reduce the drive current from the first current magnitude to a second current magnitude, the second current magnitude being smaller than the first current magnitude;

in response to the detected temperature decreasing from the second temperature threshold but remaining larger than the first temperature threshold, generate the drive signal to keep the drive current at the second current magnitude; and in response to the detected temperature decreasing to become equal to or smaller than the first temperature threshold, change the drive signal to increase the drive current from the second current magnitude to the first current magnitude; wherein the modulation-and-driver component includes:

a signal processing component configured to receive the thermal detection signal and a threshold signal and generate a first voltage signal based at least in part on the thermal detection signal and the threshold signal;

a first comparator configured to receive the first voltage signal and a current sensing signal associated with the drive current and generate a first comparison signal based at least in part on the first voltage signal and the current sensing signal;

a modulation component configured to receive the first comparison signal and generate a modulation signal based at least in part on the first comparison signal; and a drive component configured to receive the modulation signal and generate the drive signal based at least in part on the modulation signal.

17. The system controller of claim 16 wherein the signal processing component includes:

a current source component configured to provide a first current based at least in part on the detected temperature; and a voltage generator configured to generate the thermal detection signal based at least in part on the first current.

18. The system controller of claim 17 wherein the voltage generator includes one or more resistors.

19. The system controller of claim 16, further comprising:

an operation-mode detection component configured to receive a second voltage signal associated with the drive current and generate a mode detection signal based at least in part on the second voltage signal;

wherein the modulation-and-driver component is further configured to receive the first comparison signal and the mode detection signal and generate the modulation signal based at least in part on the first comparison signal and the mode detection signal.

20. A system controller for regulating one or more currents, the system controller comprising:

a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes; and an operation-mode detection component configured to receive a second voltage signal associated with the drive current and generate a mode detection signal based at least in part on the second voltage signal;

wherein the modulation-and-driver component is further configured to:

in response to the detected temperature increasing from a first temperature threshold but remaining smaller than a second temperature threshold, generate the drive signal to keep the drive current at a first current magnitude, the second temperature threshold being higher than the first temperature threshold;

in response to the detected temperature increasing to become equal to or larger than the second temperature threshold, change the drive signal to reduce the drive current from the first current magnitude to a second current magnitude, the second current magnitude being smaller than the first current magnitude;

in response to the detected temperature decreasing from the second temperature threshold but remaining larger than the first temperature threshold, generate the drive signal to keep the drive current at the second current magnitude;

in response to the detected temperature decreasing to become equal to or smaller than the first temperature threshold, change the drive signal to increase the drive current from the second current magnitude to the first current magnitude; and receive the first comparison signal and the mode detection signal and generate the modulation signal based at least in part on the first comparison signal and the mode detection signal;

wherein the modulation-and-driver component includes:

a signal processing component configured to receive the thermal detection signal and a threshold signal and generate a first voltage signal based at least in part on the thermal detection signal and the threshold signal;

a first comparator configured to receive the first voltage signal and a current sensing signal associated with the drive current and generate a first comparison signal based at least in part on the first voltage signal and the current sensing signal;

a modulation component configured to receive the first comparison signal and generate a modulation signal based at least in part on the first comparison signal; and a drive component configured to receive the modulation signal and generate the drive signal based at least in part on the modulation signal;

wherein the modulation component includes:

a current source component configured to provide a first current based at least in part on the detected temperature;

a first voltage generator configured to generate a first voltage signal based at least in part on the first current;

a second comparator configured to receive the first voltage signal and a first reference signal and generate a second comparison signal based at least in part on the first voltage signal and the first reference signal;

a gate-drive signal generator configured to generate a first gate-drive signal and a second gate-drive signal based at least in part on the second comparison signal; and a reference signal generator configured to generate the first reference signal based at least in part on the first gate-drive signal and the second gate-drive signal.

21. The system controller of claim 20, wherein the reference signal generator includes:

a first transistor including a first gate terminal, a first transistor terminal and a second transistor terminal;

a second transistor including a second gate terminal, a third transistor terminal and a fourth transistor terminal;

a third transistor including a third gate terminal, a fifth transistor terminal and a sixth transistor terminal; and a fourth transistor including a fourth gate terminal, a seventh transistor terminal and an eighth transistor terminal;

wherein:

the first gate terminal and the fourth gate terminal are configured to receive the first gate-drive signal;

the second gate terminal and the third gate terminal are configured to receive the second gate-drive signal;

the first transistor terminal and the third transistor terminal are configured to receive a lower threshold voltage associated with the first temperature threshold;

the second transistor terminal and the fourth transistor terminal are configured to, in response to the first gate-drive signal being at a third logic level, generate the first reference signal corresponding to the lower threshold voltage;

the fifth transistor terminal and the seventh transistor terminal are configured to receive an upper threshold voltage associated with the second temperature threshold; and the sixth transistor terminal and the eighth transistor terminal are configured to, in response to the second gate-drive signal being at the third logic level, generate the first reference signal corresponding to the upper threshold voltage.

22. The system controller of claim 21 wherein:

the first transistor and the third transistor are N-channel transistors; and the second transistor and the fourth transistor are P-channel transistors.

23. The system controller of claim 20 wherein the modulation component further includes:

a second voltage generator configured to receive the mode detection signal and the drive signal and generate a third voltage signal based at least in part on the mode detection signal and the drive signal;

a current generation component configured to provide a first current based at least in part on the detected temperature;

a ramp signal generator configured to receive the first current and the third voltage signal and generate a fourth voltage signal based at least in part on the first current and the third voltage signal;

a third comparator configured to receive the fourth voltage signal and a second reference signal and generate a third comparison signal based at least in part on the fourth voltage signal and the second reference signal; and a logic-operation component configured to receive the third comparison signal and the thermal detection signal and generate a logic-operation signal based at least in part on the third comparison signal and the thermal detection signal.

24. The system controller of claim 23 wherein the modulation component further includes:

a signal processor configured to receive the logic-operation signal and the second gate-drive signal and generate the modulation signal based at least in part on the logic-operation signal and the second gate-drive signal.

25. A system controller for regulating one or more currents, the system controller comprising:

a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes;

a first comparator configured to receive a first voltage signal and a current sensing signal and generate a first comparison signal based at least in part on the first voltage signal and the current sensing signal, the current sensing signal being associated with the drive current, the first voltage signal being associated with the thermal detection signal; and an operation-mode detection component configured to receive a second voltage signal associated with the drive current and generate a mode detection signal based at least in part on the second voltage signal;

wherein the modulation-and-driver component is further configured to:

in response to the detected temperature increasing to become larger than a first temperature threshold but remaining smaller than a second temperature threshold, change the drive signal to reduce the drive current approximately according to an exponential function of the detected temperature, the first temperature threshold being smaller than the second temperature threshold; and receive the first comparison signal and the mode detection signal and generate the drive signal based at least in part on the first comparison signal and the mode detection signal.

26. The system controller of claim 25 wherein the modulation-and-driver component includes:

a modulation component configured to receive the first comparison signal and the mode detection signal and generate a modulation signal based at least in part on the first comparison signal and the mode detection signal; and a driver component configured to receive the modulation signal and output the drive signal based at least in part on the modulation signal.

27. The system controller of claim 26 wherein the modulation component includes:

a signal generator configured to receive the mode detection signal and the drive signal and generate a third voltage signal based at least in part on the mode detection signal and the drive signal;

a current-generation component configured to provide a first current based at least in part on the detected temperature;

a ramp signal generator configured to receive the first current and the third voltage signal and generate a fourth voltage signal based at least in part on the first current and the third voltage signal;

a second comparator configured to receive the fourth voltage signal and a reference signal and generate a second comparison signal based at least in part on the fourth voltage signal and the reference signal; and a logic-operation component configured to receive the second comparison signal and the thermal detection signal and generate the modulation signal based at least in part on the second comparison signal and the thermal detection signal.

28. The system controller of claim 27 wherein the ramp signal generator includes:

a transistor configured to close or open in response to the third voltage signal; and a capacitor configured to be charged by the first current in response to the transistor being open and generate the fourth voltage signal.

29. The system controller of claim 27 wherein the signal generator includes one or more NOR gates and one or more NOT gate.

30. The system controller of claim 27 wherein the logic-operation component includes one or more NAND gates, one or more NOR gates, and one or more AND gates.

31. The system controller of claim 25 wherein the thermal detector is further configured to:

generate the thermal detection signal at a logic low level in response to the detected temperature being smaller than a third temperature threshold; and generate the thermal detection signal at a logic high level in response to the detected temperature being larger than the third temperature threshold.

32. A system controller for regulating one or more currents, the system controller comprising:

a thermal detector configured to detect a temperature associated with the system controller and generate a thermal detection signal based at least in part on the detected temperature; and a modulation-and-driver component configured to receive the thermal detection signal and generate a drive signal based at least in part on the thermal detection signal to close or open a switch to affect a drive current associated with one or more light emitting diodes;

wherein the modulation-and-driver component is further configured to:

in response to the detected temperature increasing to become larger than a first temperature threshold but remaining smaller than a second temperature threshold, change the drive signal to reduce the drive current approximately according to an exponential function of the detected temperature, the first temperature threshold being smaller than the second temperature threshold;

in response to the detected temperature increasing from a third temperature threshold but remaining smaller than a fourth temperature threshold, generate the drive signal to keep the drive current at a first current magnitude, the fourth temperature threshold being higher than the third temperature threshold;

in response to the detected temperature increasing to become equal to or larger than the fourth temperature threshold, change the drive signal to reduce the drive current from the first current magnitude to a second current magnitude, the second current magnitude being smaller than the first current magnitude; and in response to the detected temperature decreasing from the fourth temperature threshold but remaining larger than the third temperature threshold, generate the drive signal to keep the drive current at the second current magnitude; and in response to the detected temperature decreasing to become equal to or smaller than the third temperature threshold, change the drive signal to increase the drive current from the second current magnitude to the first current magnitude.

33. The system controller of claim 32 wherein the modulation-and-driver component is further configured to:

in response to the detected temperature remaining smaller than the first temperature threshold, generate the drive signal to keep the drive current at a third current magnitude, the first temperature threshold being smaller than the third temperature threshold and the fourth temperature threshold.

34. The system controller of claim 32 wherein the second temperature threshold is equal to the third temperature threshold.

35. The system controller of claim 32 wherein the second current magnitude is equal to zero.

36. The system controller of claim 32 wherein the second temperature threshold decreases with the first current magnitude increasing.

* * * * *